US008784081B1

(12) United States Patent
Blume

(10) Patent No.: US 8,784,081 B1
(45) Date of Patent: Jul. 22, 2014

(54) PLUNGER PUMP FLUID END

(76) Inventor: George H. Blume, Austin, TX (US)

( * ) Notice: Subject to any disclaimer, the term of this patent is extended or adjusted under 35 U.S.C. 154(b) by 621 days.

(21) Appl. No.: 13/154,464

(22) Filed: Jun. 7, 2011

Related U.S. Application Data

(63) Continuation-in-part of application No. 11/927,704, filed on Oct. 30, 2007, now abandoned, and a continuation-in-part of application No. 10/741,488, filed on Dec. 19, 2003, now abandoned, and a continuation-in-part of application No. 10/662,578, filed on Sep. 15, 2003, now Pat. No. 7,186,097.

(51) Int. Cl.
*F04B 53/16* (2006.01)
*F04B 53/10* (2006.01)
*F04B 39/12* (2006.01)

(52) U.S. Cl.
CPC ..... *F04B 53/16* (2013.01); *F04B 53/162* (2013.01); *F04B 39/122* (2013.01)
USPC ..... 417/568; 417/567; 417/559

(58) Field of Classification Search
CPC .... F04B 53/162; F04B 53/164; F04B 39/123; F04B 39/122
USPC ..... 417/53, 568, 567, 559
See application file for complete search history.

(56) References Cited

U.S. PATENT DOCUMENTS

| | | | | |
|---|---|---|---|---|
| 2,559,659 | A | 7/1951 | Redman | |
| 3,427,988 | A * | 2/1969 | Schmieman et al. | 417/569 |
| 3,489,098 | A * | 1/1970 | Roth et al. | 92/153 |
| 3,679,332 | A * | 7/1972 | Yohpe | 417/503 |
| 4,508,133 | A * | 4/1985 | Hamid | 137/68.22 |
| 4,520,837 | A * | 6/1985 | Cole et al. | 137/68.23 |
| 4,771,801 | A * | 9/1988 | Crump et al. | 137/68.26 |
| 5,073,096 | A * | 12/1991 | King et al. | 417/454 |
| 5,226,445 | A * | 7/1993 | Surjaatmadja | 137/516.29 |
| 5,246,355 | A * | 9/1993 | Matzner et al. | 417/521 |
| 5,362,215 | A | 11/1994 | King | |
| 6,382,940 | B1 * | 5/2002 | Blume | 417/571 |
| 6,544,012 | B1 * | 4/2003 | Blume | 417/559 |
| 6,623,259 | B1 * | 9/2003 | Blume | 417/559 |
| 6,910,871 | B1 * | 6/2005 | Blume | 417/571 |
| 7,186,097 | B1 * | 3/2007 | Blume | 417/454 |
| 7,335,002 | B2 * | 2/2008 | Vicars | 417/360 |
| 7,341,435 | B2 * | 3/2008 | Vicars | 417/360 |
| 7,513,759 | B1 * | 4/2009 | Blume | 417/568 |

* cited by examiner

*Primary Examiner* — Charles Freay
*Assistant Examiner* — Alexander Comley

(57) ABSTRACT

Plunger pump fluid ends incorporate housings with structural features that facilitate manufacture while providing improved internal access, reduced weight, and reduced likelihood of fatigue failures compared to conventional fluid end housings. Certain fluid ends incorporate frangible pressure relief means in suction valves for protection from overpressure-induced catastrophic failure. Oblong bore transition areas, when present, and barrel-profile central cavities provide obtuse bore intersection angles and effectively reduce fluid end weight while reducing peak cyclic fluid end housing stress by redistributing stress within the fluid end housing.

7 Claims, 25 Drawing Sheets

PLUNGER PUMP FLUID END

This is a continuation-in-part (CIP) of U.S. patent application Ser. No. 11/927,704, which was a CIP of U.S. patent application Ser. No. 10/741,488 (now abandoned), which was a CIP of U.S. patent application Ser. No. 10/662,578 (U.S. Pat. No. 7,186,097), and is related in-part to U.S. Pat. No. 6,957,605 B1, U.S. Pat. No. 7,168,361 B1, and U.S. patent application Ser. No. 11/927,707.

FIELD OF THE INVENTION

The invention relates generally to high-pressure plunger pumps used, for example, in oil field operations.

BACKGROUND

Engineers typically design high-pressure oil field plunger pumps in two sections; the (proximal) power section (herein "power end") and the (distal) fluid section (herein "fluid end"). The power end usually comprises a crankshaft, reduction gears, bearings, connecting rods, crossheads, crosshead extension rods, etc. Commonly used fluid ends typically comprise a fluid end housing having one or more sub-assemblies, each sub-assembly comprising a central cavity, a suction valve in a suction bore, a discharge valve in a discharge bore, a plunger in a plunger bore, and an access bore plug in an access bore, plus retainers and high-pressure seals (including plunger packing), etc.

FIG. 1 shows a cross-sectional schematic view of such a typical fluid end sub-assembly showing its connection to a power end by stay rods. A plurality of fluid end sub-assemblies similar to that illustrated in FIG. 1 may be combined, as suggested in the Triplex fluid end housing design schematically illustrated in FIG. 2.

Components internal to the fluid end housing typically include a suction valve for controlling fluid flow in the suction bore, a discharge valve for controlling fluid flow in the discharge bore, and an access bore plug for reversibly sealing access to the central cavity via the access bore. Note that the terminology applied to fluid end sub-assembly suction and discharge valves varies according to the industry (e.g., pipeline or oil field service) in which the valve is used. In some applications, the term "valve" means just the moving element or valve body, whereas the term "valve" as used typically herein includes the valve body, the valve seat, one or more valve guides to control the motion of a valve body, and one or more valve springs that tend to hold a valve closed (i.e., with the valve body reversibly sealed against the valve seat), plus spring retainers, spacers, etc.

Fluid end housings are subject to catastrophic failure (due, for example, to severe over-pressure caused by an obstruction in the fluid discharge path), as well as fatigue failure associated with peaks of cyclic stress resulting from alternating high and low pressures which occur with each stroke of a plunger cycle. Local maxima of peak cyclic stress are concentrated near various structural features of a fluid end housing. Catastrophic failures are relatively infrequent but fluid end housings fail more commonly in areas of cyclic stress concentration where fatigue is greatest. For example, fatigue cracks may develop in one or more of the areas defined by the intersections of the suction, plunger, access and discharge bores with the central cavity as schematically illustrated in the (generally right-angular) bore intersections schematically illustrated in FIG. 3.

To reduce the likelihood of fatigue cracking in fluid end housings, a Y-block housing design has been proposed. The Y-block design, which is schematically illustrated in FIGS. 4 and 5, reduces stress concentrations in a fluid end housing such as that shown in FIG. 3 by increasing the angles of bore intersections above 90°. In the illustrated example of FIG. 4, the bore intersection angles are approximately 120°. A more complete cross-sectional view of a Y-block fluid end sub-assembly is schematically illustrated in FIG. 5. Note the absence of an access bore as shown in FIGS. 1 and 3.

Although several variations of the Y-block design have been evaluated for field use, none have become commercially successful for several reasons. One reason is that mechanics find field maintenance on Y-block fluid ends relatively difficult. For example, the absence of an access bore makes replacement of plungers and/or plunger packing significantly more complicated in Y-block designs than in the design shown in FIG. 1. Access to both a plunger and its packing in a fluid end sub-assembly like that of FIG. 1 is conveniently achieved by pushing the plunger distally through the plunger bore and out through the access bore, followed by removal of the packing proximally. This operation, which leaves the plunger packing easily accessible from the proximal end of the plunger bore, is impossible in a Y-block design. And since a plunger must fit very tightly within its packing, removal of the plunger packing with the plunger in place (as seen, for example, in FIG. 6) is very difficult in the field. Thus, notwithstanding their nominally higher resistance to fatigue failures at bore intersections, Y-block fluid ends have rarely been used when a fluid end similar to the design shown in FIG. 1 is available.

A brief review of plunger packing design will illustrate some of the problems associated with packing and plunger field maintenance in Y-block fluid ends. FIG. 6 schematically illustrates an enlarged view of the packing in an earlier (but still currently used) fluid end sub-assembly such as that shown in FIG. 1. In FIG. 6, the packing and packing brass are shown installed in the packing box of the fluid end sub-assembly. Note that "packing brass" is a term used by field mechanics to describe bearing bronze, where the bronze has the appearance of brass.

In the fluid end sub-assembly portion schematically illustrated in FIG. 6, the packing box is an integral part of the fluid end housing; it may also be a separate unit bolted to the housing. The packing is retained by the gland nut, and the tightness of the packing about the plunger may be increased by turning the gland nut. Loosening or removing the gland nut, however, does little to release the tight fit of the packing rings on the plunger. Since the packing rings must block high-pressure fluid leakage past the plunger they are typically quite stiff, and they remain substantially inaccessible in the packing box while the plunger (or any piece of it) remains in the plunger bore. FIG. 7 schematically illustrates such a situation, with the gland nut removed from the packing box and the distal end of the plunger (i.e., the pressure end) remaining within the box. Note that even though the plunger is shown disconnected from the crosshead extension rod, the plunger pressure end still cannot be rotated for removal until it has been withdrawn sufficiently to completely clear the packing brass. In view of the limited space between the power and fluid ends, withdrawal of the plunger is facilitated if it comprises two or more pieces reversibly connected together. But the advantage of being able to deal with two relatively short plunger pieces is somewhat offset by the necessity for disconnecting and reconnecting the pieces when replacing or otherwise servicing the plunger packing.

The field maintenance problems associated with multipiece plungers in Y-block fluid end housings have not been eliminated by the recent introduction of packing assemblies such as those called "cartridge packing" by UTEX Industries in Houston, Tex. An example of such cartridge packing is schematically illustrated in FIG. 8. Note that removal of the gland nut exposes the packing cartridge housing, which in turn may be fitted with attachment means to allow extraction of the packing cartridge from the packing box (commonly requiring proximal travel of the packing cartridge housing of approximately three to five inches).

Even with use of the above attachment means however, extraction of the packing cartridge is not practical while a plunger piece lies within the packing box. This is because of the substantial drag force of the compressed packing rings on the plunger and packing box walls. Unfortunately, the drag force can not be reduced unless all plunger pieces are removed from the packing box so as to release the compression of the packing rings. Further, any slight misalignment of the attachment means and/or the apparatus used to extract such a packing cartridge assembly tends to cause binding of the (right cylindrical, i.e., not tapered) cartridge within the (right cylindrical) bore in which it is installed. Analogous difficulties occur if an attempt is made to replace such a cartridge packing assembly while a plunger or part thereof lies in the packing box area. Hence, even if such cartridge packing assemblies were used in Y-block fluid section housings with multi-piece plungers, field maintenance would still be relatively complicated and expensive.

Thus, although the Y-block fluid end housing is characterized by a generally lower likelihood of fatigue failure than earlier right-angular fluid end housing designs, it is also associated with significant operational disadvantages. Improved fluid ends would offer weight reduction, easier internal access for maintenance, and/or reduced likelihood of catastrophic and/or fatigue failures.

SUMMARY

Susceptibility to fatigue-related failures in the improved plunger pump fluid end housings described herein is relatively low because stress is redistributed in these housings. Barrel-profile central cavities and other structural features of improved plunger pump fluid end housings facilitate reductions of local maxima of peak cyclic stress near stress concentrations in the central cavity wall, while increasing local maxima of peak cyclic stress in areas of the central cavity wall more distant from stress concentrations (i.e., where stress is relatively less concentrated in the central cavity wall). Stress in the central cavity wall is thus redistributed.

Barrel-profile central cavities as described herein have common structural features, including a generally symmetrical form about a longitudinal axis. Each barrel-profile central cavity has first and second ends through which fluid communication is facilitated between the barrel-profile central cavity and a first bore and a second bore respectively in a fluid end housing. Thus, a barrel-profile central cavity connects the first and second bores. The first and second bores each have a longitudinal axis collinear with the longitudinal axis of the barrel-profile central cavity. Each barrel-profile central cavity has a maximum transverse diameter between the relatively smaller transverse diameters of first and second chamfers near the first and second ends respectively. A third bore and a fourth bore in a fluid end housing each intersect the barrel-profile central cavity at third and fourth bore intersections respectively. Longitudinal axes of the third and fourth bores are perpendicular to the longitudinal axis of the barrel-profile central cavity, and all bore axes lie in a common plane (i.e., they are coplanar). The first central cavity chamfer intersects a portion of the first bore, as well as portions of the third and fourth bores. Analogously, the second central cavity chamfer intersects a portion of the second bore, as well as portions of the third and fourth bores. Structural features of the first and second chamfers (e.g., chamfer width and/or chamfer angulation with respect to the central cavity longitudinal axis) can be iteratively adjusted to optimize stress redistribution according to predetermined criteria.

Structural features near which peak cyclic stress tends to be concentrated include threads, bolt holes, portions of bore intersections with a central cavity, and both inside and outside corners of a barrel-profile central cavity wall. Structural features and methods are described herein for ameliorating the adverse effects of certain stress concentrations by stress redistribution. Surprisingly, the benefits of stress redistribution in the central cavity wall are accompanied in various fluid end embodiments described herein by relatively lighter weight, lower cost, higher quality, and/or easier maintenance. Internal access to pump components is improved as weight is reduced, and pressure relief means (e.g., frangible rupture disks and/or reset pressure relief valves) in certain pump embodiments function to avert catastrophic failures by relieving overpressures within the pumps. Certain structural features of fluid ends described herein are described in U.S. Pat. Nos. 7,186,097; 6,955,339; 6,910,871; and 6,679,477; all four patents incorporated herein by reference.

An embodiment of a plunger pump fluid end comprises at least one fluid end sub-assembly analogous in part to that schematically illustrated in FIG. 9 or FIG. 10. The fluid end sub-assembly comprises a plunger pump fluid end housing having a barrel-profile central cavity communicating with each of four bores: a suction bore, a discharge bore, a plunger bore and an access bore. Examples of various styles of valves, valve guides, valve spring retainers, etc. are shown.

Each of the four bores has a longitudinal axis and a bore transition area, each bore transition area being that portion of the respective bore near where the bore communicates with the barrel-profile central cavity. All of the bore longitudinal axes lie substantially in a common plane (i.e., are coplanar), and the transition area of each bore opens on the central cavity. Bore transition areas may have circular cross-sections, in which case they are substantially cylindrical in shape. But alternative fluid end housing embodiments may comprise one or more bores having an oblong bore transition area. An oblong bore transition area is generally elongated in transverse cross-section, with major and minor axes, each major axis being substantially perpendicular to the common plane of the bore longitudinal axes. An oblong bore transition area may be substantially cylindrical, as, for example, the access bore transition area 375 schematically illustrated in FIGS. 18 and 22. An oblong bore may also be flared or tapered outward near where it meets a barrel-profile central cavity (see, e.g., transition areas 345, 335 and 385 in FIGS. 20, 21 and 23 respectively).

In the conventional configuration fluid end housing shown schematically in FIG. 11 and labeled Prior Art, each of four bores communicates with a central cavity and is at right angles to two other bores. The right-angular intersections of the bores with the central cavity are commonly associated with one or more bore intersection angles of approximately 90 degrees. During pump operation, fluid end housing stress tends to be concentrated near these bore intersections, which can lead to excessive wear and/or premature fatigue failure of the housing.

Conventional designs for plunger pump fluid end housings may compensate for the above stress concentrations by adding or retaining material to bolster wall thickness near bore intersections. See, e.g., the relatively thick walls adjacent to the right-angular intersection of the plunger bore with an internal cavity shown in FIG. 1 of U.S. Pat. No. 3,489,098 (Roth et al.).

The pump design illustrated in Roth et al. contrasts with designs described herein. In the latter designs, finite element analysis (FEA) has been used to study stress concentrations near bore intersections with a central cavity and in other portions of a central cavity wall. Surprisingly, FEA reveals that local maxima of peak cyclic stress (i.e., local maxima of fluid end housing stress associated with a plunger pressure stroke) can be reduced near such bore intersections through redistribution of stress to other portions of a central cavity wall. As described herein, FEA can be used to guide fluid end housing design to reduce local maxima of peak cyclic stress near areas of stress concentration (e.g., inside corners of barrel-profile central cavities or bore intersections), while increasing local maxima of peak cyclic stress in portions of a central cavity wall more distant from areas of stress concentration through stress redistribution by dual material removal operations.

During dual material removal operations, material is removed from a plunger pump housing adjacent to bore intersections with a central cavity, in conjunction with removal of material from portions of the central cavity wall more distant from the bore intersections. At least a first local maximum of fluid end housing peak cyclic stress relatively near an area of stress concentration is reduced after dual material removal. And, at least a second local maximum of fluid end housing peak cyclic stress is increased in portions of the central cavity wall relatively more distant from the area of stress concentration after dual material removal as described herein. Such an increase in one or more local maxima of peak cyclic stress may be tolerated in order to gain the benefit of an associated reduction in one or more local maxima of peak cyclic stress near areas of stress concentration.

Dual material removal operations comprise the machining of barrel-profile central cavities as described herein. Chamfers near each end of a barrel-profile central cavity may be dimensioned to achieve a predetermined reduction in a first local maximum of peak cyclic stress relatively near an area of stress concentration, while a second local maximum of peak cyclic stress in a portion of the central cavity wall relatively more distant from the area of stress concentration is increased by a predetermined amount. Thus, a ratio of the first local maximum of peak cyclic stress to the second local maximum of peak cyclic stress is altered by a predetermined amount, the desired predetermined amount(s) in particular cases being determined by individual design factors and (iteratively) optimized based on overall design criteria (e.g., cost, materials, duty cycle, pressures, reliability, etc.). The barrel-profile central cavity chamfers eliminate all right-angular bore intersection angles, while reducing central cavity wall thickness in areas relatively more distant from bore intersections. After such dual material removal operations, all bore wall intersection angles are obtuse. Besides redistributing stress, dual material removal operations also improve internal access for fluid end maintenance while reducing both fluid end weight and material cost.

As schematically illustrated herein, inside corners of each barrel-profile central cavity are radiused to reduce local maxima of peak cyclic fluid end housing stress near each inside corner. The term "radiused" as applied herein to one or more inside corners refers to a fillet of substantially constant radius as indicated. For example, a fluid end housing may comprise a central cavity comprising a plurality of inside corners, each inside corner having a radius substantially equal to at least 10% of the maximum transverse diameter of the central cavity. The term "radiused" may also be applied herein to one or more outside corners, wherein it refers to a rounding of the outside corner(s), the rounding being of substantially constant radius as indicated.

Note that the above reduction of one or more local maxima of peak cyclic fluid end housing stress is paradoxical in that it follows material removal from relatively thick fluid end housing structures, rather than retention or augmentation of the thick structures. Note also that the surprising benefits of stress redistribution can be optimized to a predetermined extent by applying FEA or analogous analysis in iterative designs using a variety of manufacturing process variables.

Bore intersection angles are made obtuse, as schematically illustrated herein, by chamfering each end of a barrel-profile central cavity. Such angles may also be modified (as by adding angular segments and/or by radiusing one or more angles) to reduce stress. Further, barrel-profile central cavities allow such chamfers to be accurately and repeatably machined about a predetermined axis (e.g., by CNC work stations), facilitating superior quality control of finished fluid end housings compared to that obtainable with conventional hand grinding near bore intersections.

Thus, a plunger pump fluid end housing schematically illustrated herein comprises a suction bore having a suction bore longitudinal axis and a suction bore transition area, a plunger bore having a plunger bore longitudinal axis and a plunger bore transition area, an access bore having an access bore longitudinal axis and an access bore transition area, and a discharge bore having a discharge bore longitudinal axis and a discharge bore transition area. The discharge bore longitudinal axis is substantially collinear with the suction bore longitudinal axis to form a common axis. A barrel-profile central cavity connects the suction bore transition area and the discharge bore transition area, and intersects the piston bore transition area and the access bore transition area. The central cavity is formed symmetrically about the common axis and has a maximum transverse diameter between relatively smaller transverse diameters of first and second end chamfers adjacent to the suction bore and discharge bore transition areas respectively. The first end chamfer intersects the suction bore transition area, the access bore transition area, and the plunger bore transition area. The second end chamfer intersects the discharge bore transition area, the access bore transition area, and the plunger bore transition area. Each bore transition area has a plurality of bore intersection angles with the barrel-profile central cavity, and each bore intersection angle is obtuse. All of the bore longitudinal axes are coplanar.

In alternative embodiments a central cavity may connect the plunger bore transition area with the access bore transition area. Each barrel-profile central cavity of such alternative embodiments is symmetrical about a common axis comprising the collinear longitudinal axes of the plunger and access bores. This alternative central cavity is intersected by suction and discharge bore transition areas and, as in the above embodiment, all bore intersection angles are obtuse and all bore longitudinal axes are coplanar.

Producing the above fluid end housing is facilitated by a method of designing a plunger pump fluid end housing to redistribute stress. The method comprises providing a plunger pump fluid end housing design comprising a first bore having a first bore longitudinal axis and a first bore transition area, a second bore having a second bore longitudinal axis and a second bore transition area, a third bore having a third bore longitudinal axis and a third bore transition area, and a fourth bore having a fourth bore longitudinal axis and a fourth bore transition area. The first and second bore longitudinal axes are substantially collinear to form a common axis, and all bore longitudinal axes are coplanar.

The next step is adding a barrel-profile central cavity in fluid communication with the first, second, third and fourth bores. The barrel-profile central cavity has a central cavity wall and connects the first and second bore transition areas, the central cavity being formed substantially symmetrically about the common axis and having a maximum transverse diameter between relatively smaller transverse diameters of first and second end chamfers adjacent to the first and second bore transition areas respectively. The first end chamfer intersects the first bore transition area, the third bore transition area, and the fourth bore transition area. The second end chamfer intersects the second bore transition area, the third bore transition area, and the fourth bore transition area. Each bore transition area has a plurality of bore intersection angles with the barrel-profile central cavity, and each bore intersection angle is obtuse.

A first local maximum peak cyclic stress (relatively near a stress concentration in the central cavity wall), and a second local maximum peak cyclic stress (more distant from the stress concentration in the central cavity wall) are estimated (e.g., using FEA or analogous analysis). In light of its relative nearness to a stress concentration, the first local maximum peak cyclic stress will in general be greater than the second local maximum peak cyclic stress. A ratio of the first local maximum peak cyclic stress to the second local maximum peak cyclic stress is then estimated, and it will generally be greater than one. Iteratively returning to the step in the method where the central cavity is added, the maximum transverse diameter of the central cavity is adjusted to alter the estimated ratio by a predetermined amount (e.g., to make the estimated ratio relatively closer to one), thus designing a plunger pump fluid end housing to redistribute stress.

As schematically illustrated herein, one embodiment of a plunger pump fluid end housing comprises a barrel-profile central cavity substantially symmetrical about a common axis comprising the collinear longitudinal axes of the suction and discharge bores. See, e.g., FIG. 12.

An alternative embodiment of a plunger pump fluid end housing comprises a barrel-profile central cavity substantially symmetrical about a common axis comprising the collinear longitudinal axes of the plunger and access bores. This embodiment is schematically illustrated in FIG. 24.

Terminology herein reflects conventions including the following. Where indicated as being parallel, perpendicular, right-angular, symmetrical, collinear, coplanar, etc., axes and structures described herein may vary somewhat from these precise conditions due, for example, to manufacturing tolerances, while still substantially reflecting any advantageous features described. The occurrence of such variations in certain manufacturing practices means, for example, that plunger pump housing embodiments may vary somewhat from a precise right-angular configuration. Where the lines and/or axes forming the sides of an angle to be measured are not precisely coplanar, the angle measurement is conveniently approximated using projections of the indicated lines and/or axes on a single plane in which the projected angle to be approximated is maximized. A structure or portion thereof that is termed cylindrical has a substantially constant transverse cross-section along at least a portion of a longitudinal axis (i.e., the cylindrical portion is not tapered or flared).

DETAILED DESCRIPTION

Most structural features of the illustrated embodiments appear in several drawings, and reference is made to one or more of the Figures for convenience in labeling and/or visibility. The suction bore maximum seat taper diameter T and the suction bore valve body clearance diameter S are conveniently shown on the FIGS. 14 and 15, as is the barrel-profile central cavity maximum transverse diameter (MTD). The central cavity wall 96 of barrel-profile central cavity 99' is labeled in FIG. 12, as are first end chamfer 98 and second end chamfer 97.

Figure 16:
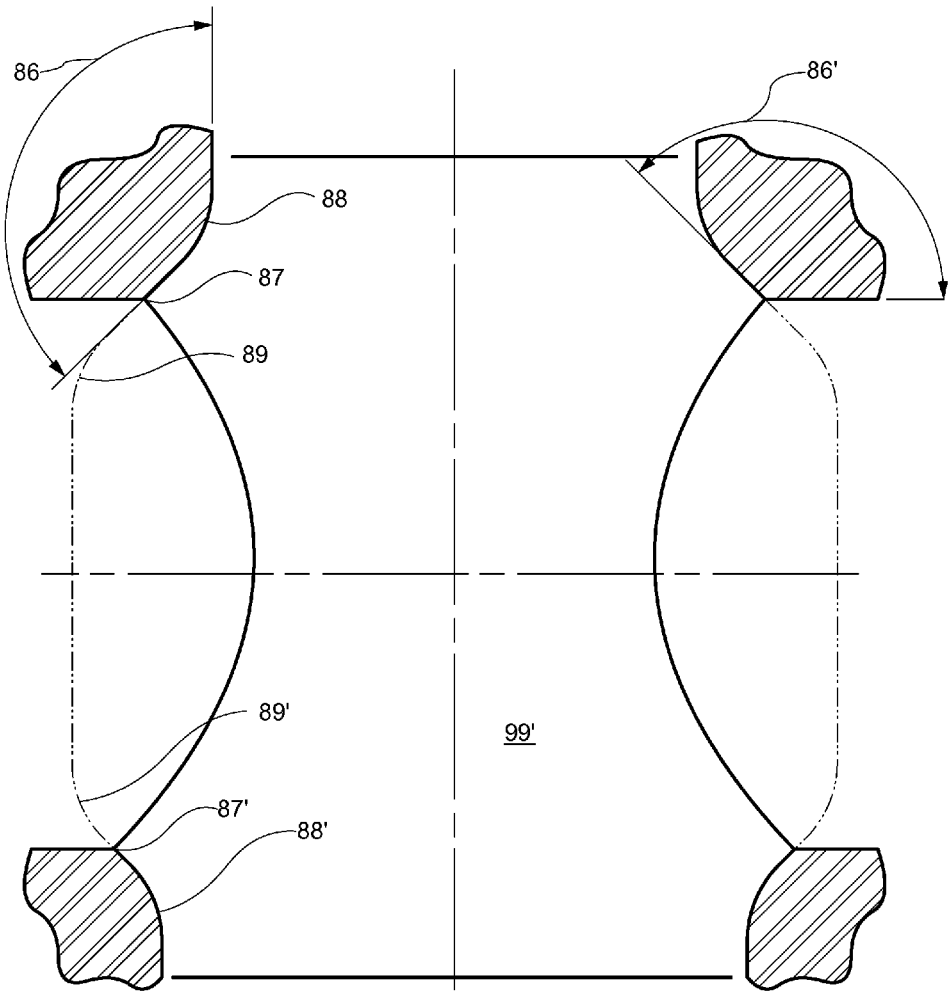
FIG. 16 schematically illustrates an enlargement of the partial cross-section 16-16 indicated on FIG. 13, showing radiused outside corners 88 and 88' as in the barrel-profile central cavity 99' of FIG. 12.
Figure 17:
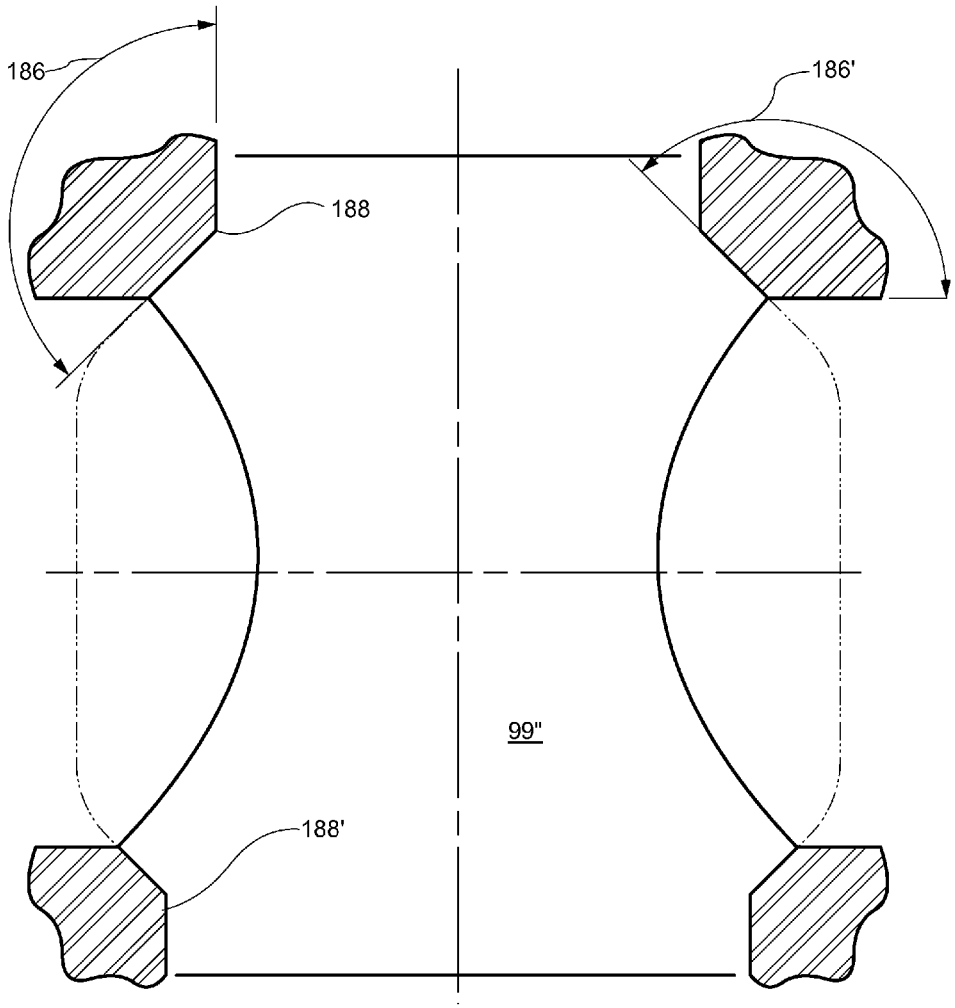
FIG. 17 schematically illustrates an alternative embodiment analogous to the partial cross-section shown in FIG. 16 wherein outside corners 188 and 188' are angular instead of being radiused.
Figure 18:
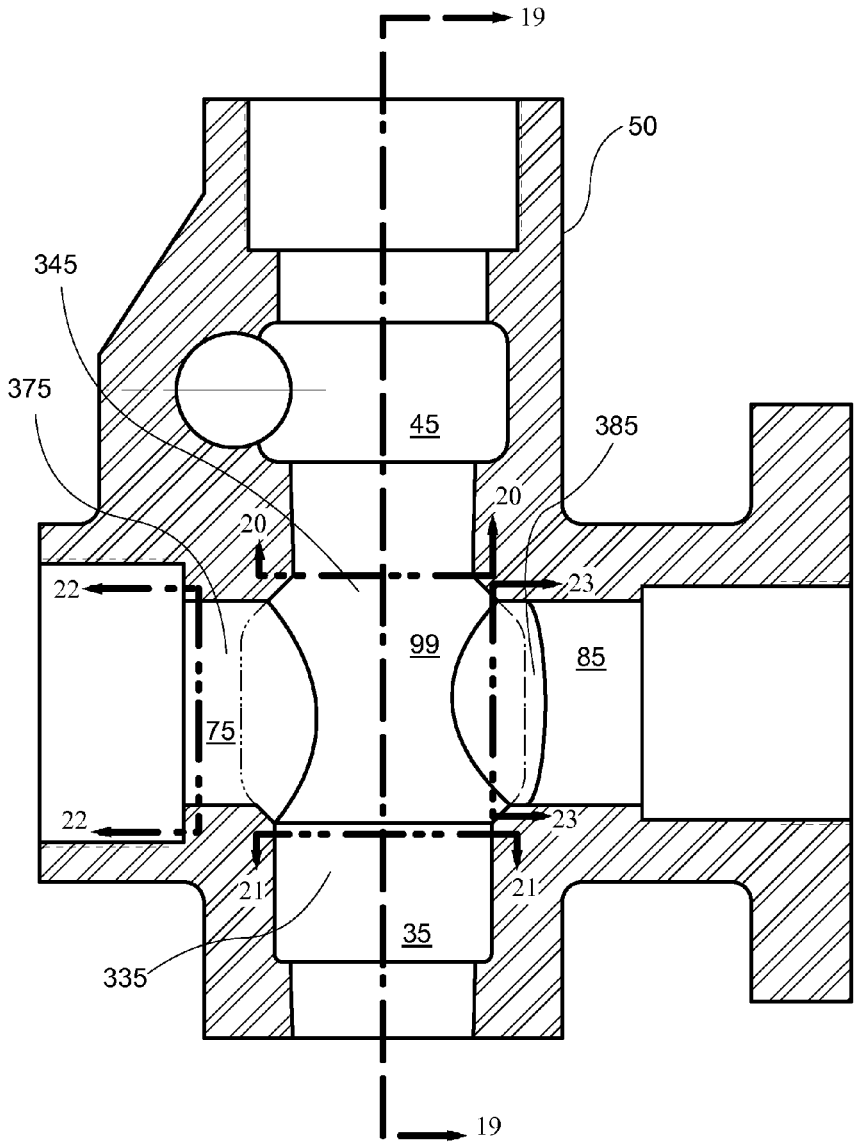
FIG. 18 is a cross-sectional view analogous to that of FIG. 13, but which differs from that of FIG. 13 by schematically illustrating the bore intersection lines of oblong transition areas of the suction, discharge, plunger and access bores with a barrel-profile central cavity.
Figure 19:
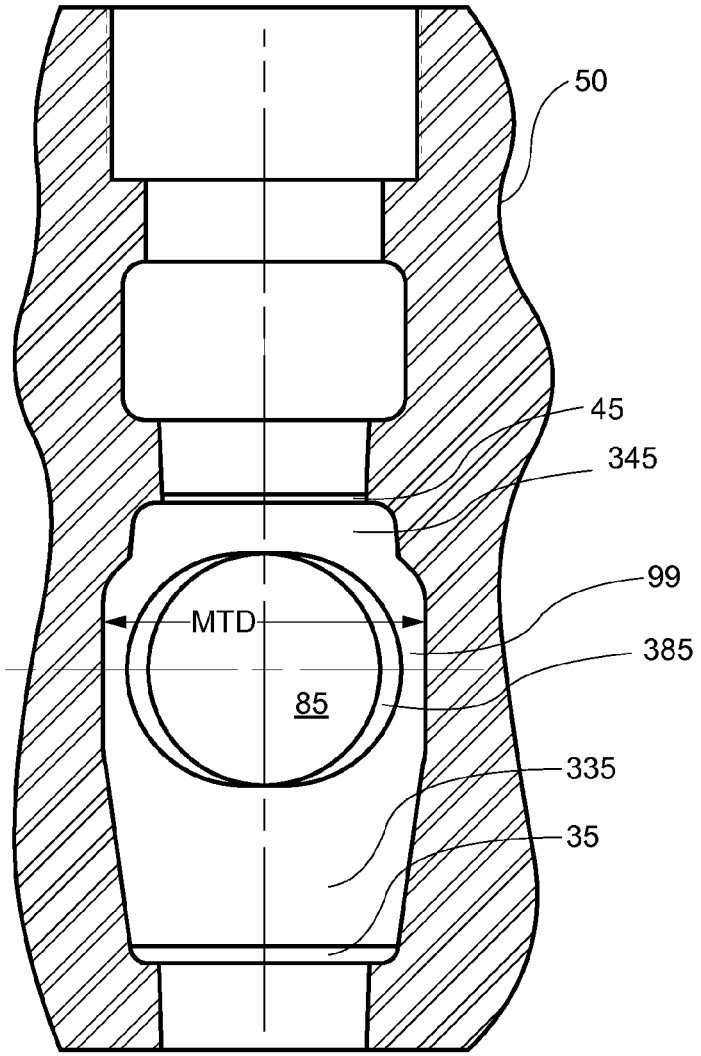
FIG. 19 schematically illustrates the cross-sectional view 19-19 indicated on FIG. 18 showing the plunger bore transition area's elongated transverse cross-section.
Figure 20:
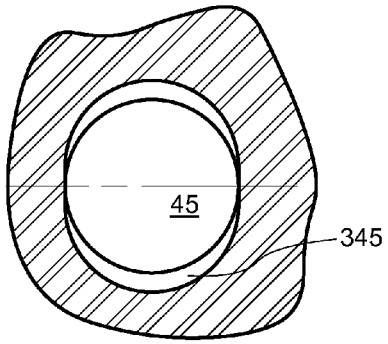
FIG. 20 schematically illustrates the cross-sectional view 20-20 indicated on FIG. 18 showing the discharge bore transition area's elongated transverse cross-section.
Figure 21:
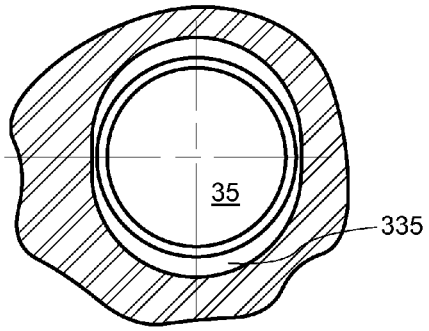
FIG. 21 schematically illustrates the cross-sectional view 21-21 indicated on FIG. 18 showing the suction bore transition area's elongated transverse cross-section.
Figure 22:
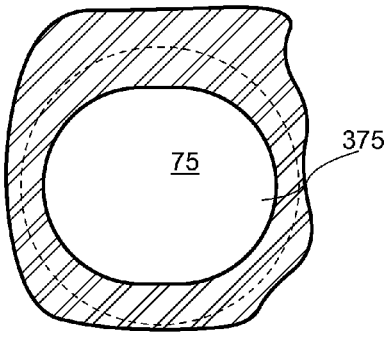
FIG. 22 schematically illustrates the cross-sectional view 22-22 indicated on FIG. 18 showing the access bore transition area's elongated transverse cross-section.
Figure 23:
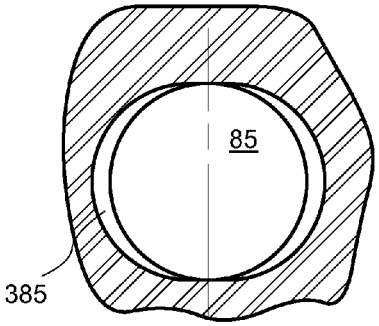
FIG. 23 schematically illustrates the cross-sectional view 23-23 indicated on FIG. 18 showing the plunger bore transition area's elongated transverse cross-section.

Bore intersection angles associated with a barrel-profile central cavity may be seen in several Figures and examples are labeled in FIG. 16 (86 and 86') and in FIG. 17 (186 and 186'). The outwardly flared oblong bore transition area 345 of discharge bore 45 is seen in FIG. 20. The outwardly flared oblong bore transition area 335 of suction bore 35 is seen in FIG. 21. The cylindrical oblong bore transition area 375 of access bore 75 is seen in FIGS. 18 and 22. And the outwardly flared oblong bore transition area 385 of piston bore 85 is seen in FIG. 23.

Plunger pump housings described herein can be fitted with a discharge valve, an access bore plug, and plunger packing secured (e.g., by threaded retainers, including a gland nut for securing the plunger packing) in, respectively, the discharge bore, the access bore, and the plunger bore. A suction valve may be secured in the suction bore, and in certain embodiments the suction valve may comprise frangible pressure relief means. Frangible pressure relief means may comprise, for example, at least one frangible disk (rupture disk) transversely sealing a longitudinal fluid passage through the valve body of the suction valve. Such frangible pressure relief means are described, for example, in U.S. Pat. No. 4,687,421 (herein the '421 patent), which is incorporated herein by reference.

In embodiments schematically illustrated herein, suction and discharge valve seats are shown pressed into tapered portions of the suction and discharge bores respectively. The discharge valve lower stem guide and the suction valve top stem guide are spaced apart and retained in position by at least one side spacer as described in the '871 patent.

Figure 9:
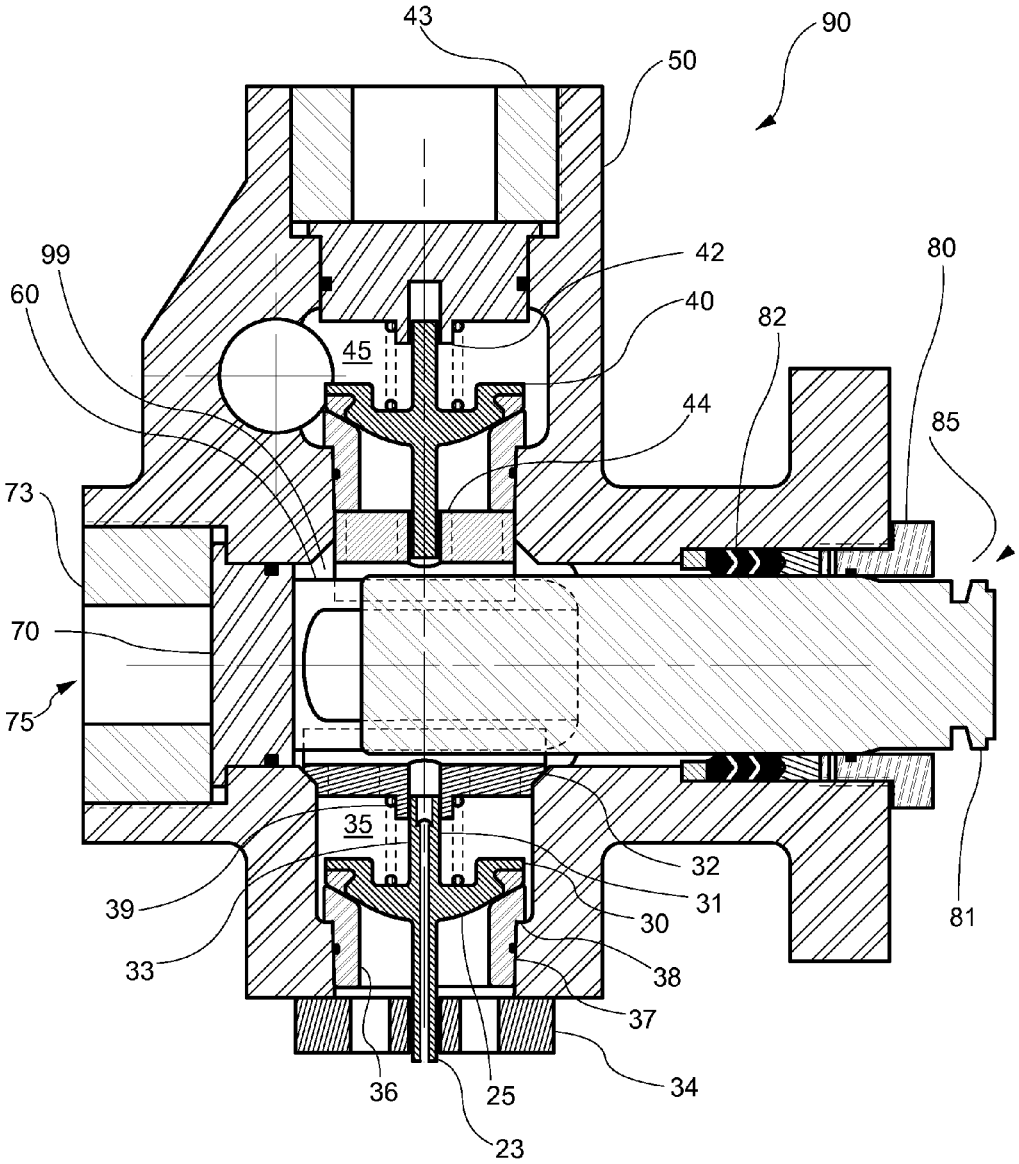
FIG. 9 schematically illustrates a cross-section of a fluid end sub-assembly, including suction and discharge valves with their respective valve spring retainers and valve guides. Note the top and lower stems and guides for the suction valve, the valve comprising frangible pressure relief means in the form of a frangible disk transversely sealed in a longitudinal fluid passage within the top stem.

Note that in the illustrated embodiments herein, spring retainer means for the suction valve are incorporated in the suction valve top stem guide, while a top stem guide and spring retainer means for the discharge valve are incorporated in a discharge bore plug that is secured by a threaded retainer. A lower stem guide for the suction valve as shown in FIG. 9 is incorporated in a portion of the suction manifold, a separate structure which abuts the fluid end sub-assembly housing. In contrast, the suction valve shown in FIG. 10 has a top stem guide but no lower stem guide. For this description and other portions of this application, a variety of types of valve guides and valve spring retainer means are illustrated and described because the various embodiments of the invention can employ combinations of these structures as well as others cited herein and in the referenced applications.

Figure 10:
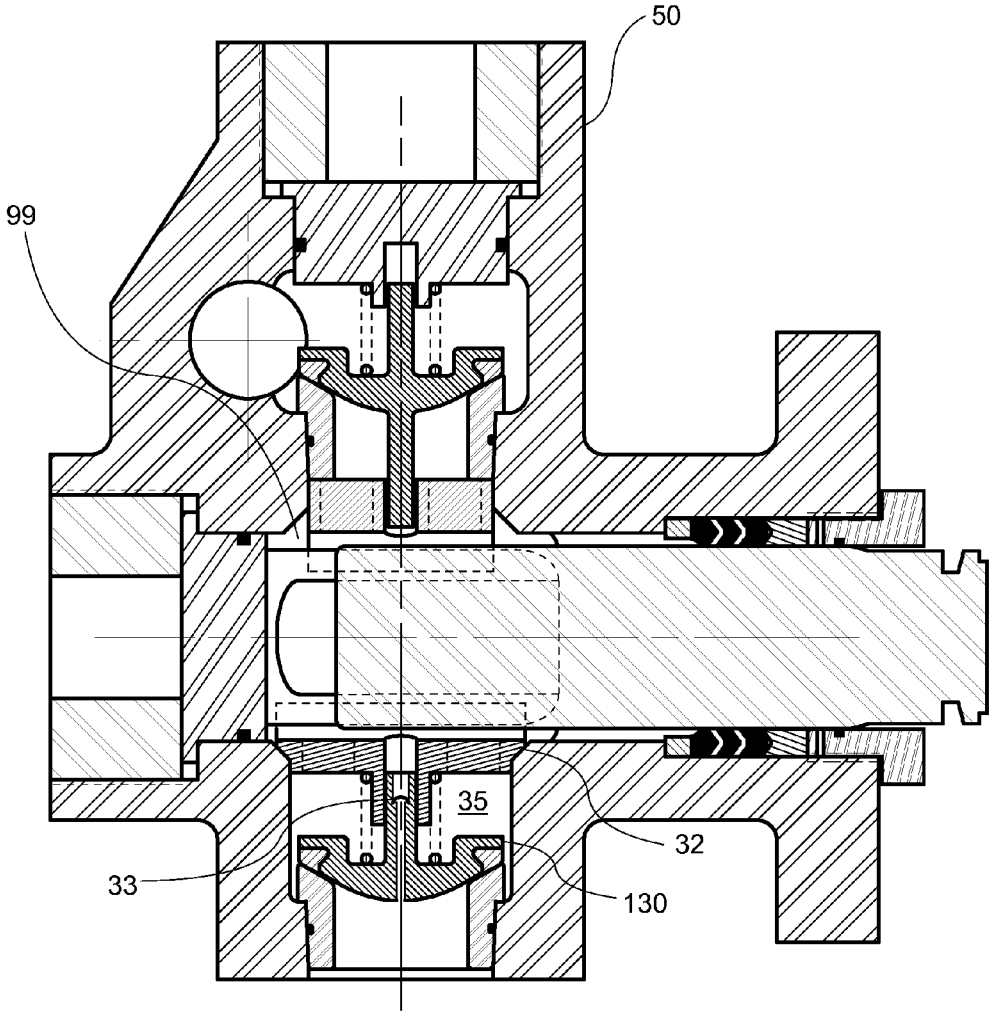
FIG. 10 schematically illustrates a cross-section of a fluid end sub-assembly analogous to that in FIG. 9, but wherein the suction valve is solely guided by a top stem. The suction valve comprises frangible pressure relief means in the form of a frangible disk transversely sealed in a longitudinal fluid passage within the top stem.

Conventional plunger packing (comprising, for example, chevron-shaped packing rings with "packing brass" in the form of bronze rings) is schematically illustrated FIGS. 9 and 10 secured by a gland nut in the plunger bore for sealing reciprocating movement of the plunger in the plunger bore. Plunger packing in fluid ends of the present invention may alternatively comprise the UTEX cartridge packing mentioned above, a tapered cartridge packing assembly as described in the '097 patent, or variations of any of these forms of plunger packing.

Figure 27:
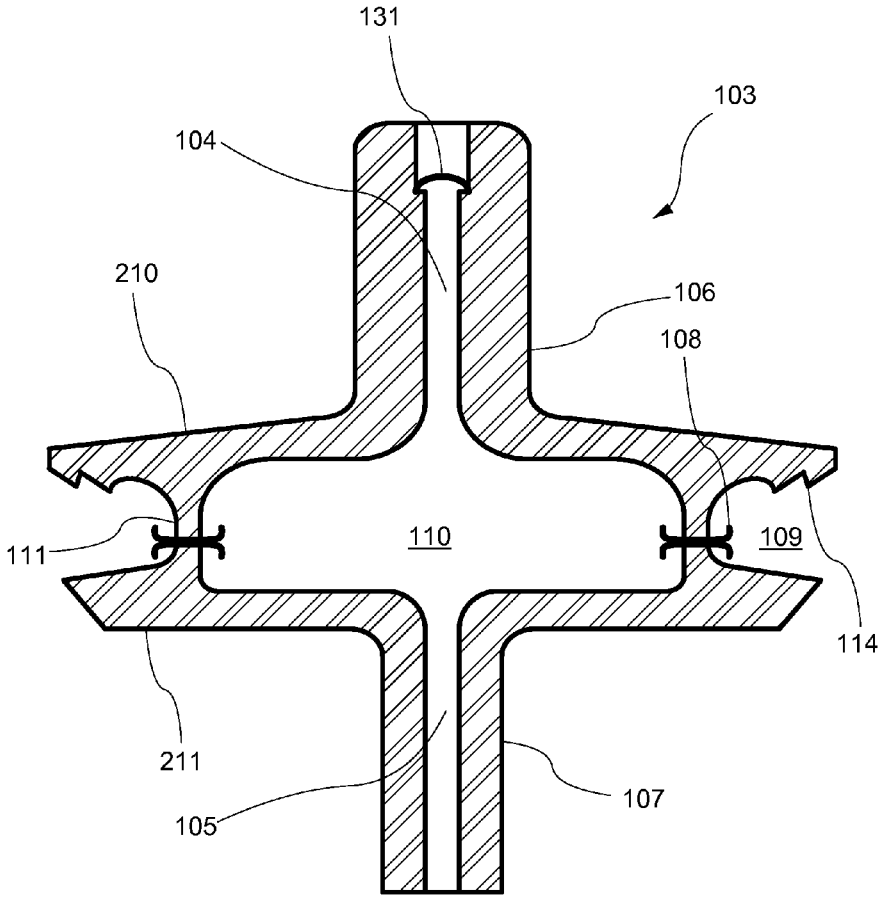
FIG. 27 schematically illustrates a cross-section of a valve body enclosing a hollow, plus frangible pressure relief means present in the form of a frangible disk transversely sealed in a longitudinal fluid passage within the top guide stem.
Figure 28:
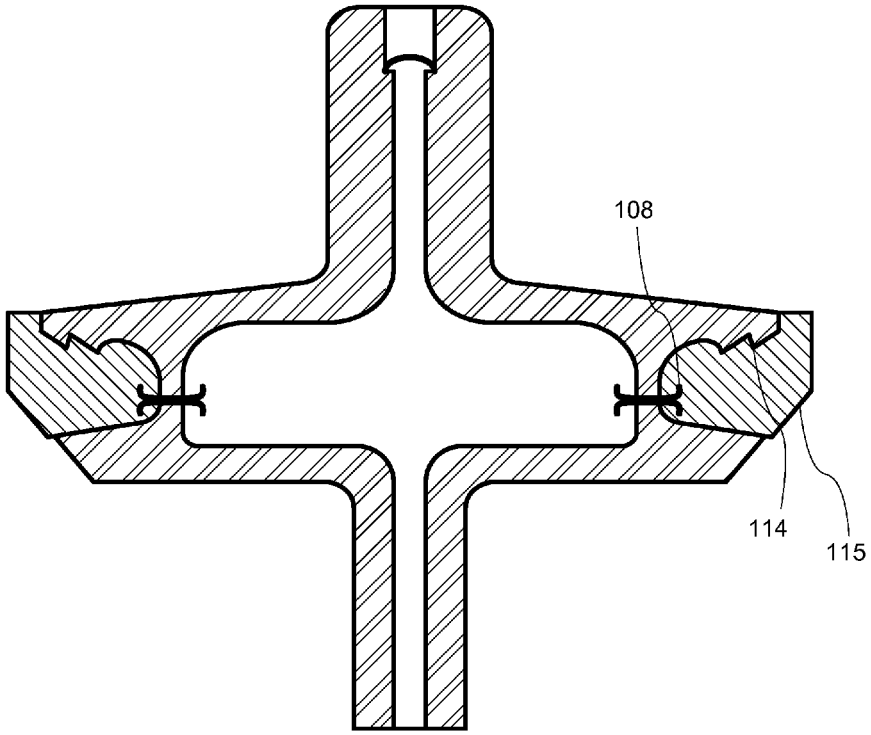
FIG. 28 shows the cross-sectional view of FIG. 27 with the addition of a cast-in-place elastomeric seal.

Also schematically illustrated herein are valve bodies for use in a stem-guided valve (see FIGS. 27 and 28). The valve bodies comprise first and second portions symmetrical about first and second longitudinal axes respectively. The first and second longitudinal axes are collinear and form a common longitudinal axis, the first and second portions being joined through a cylindrical web of predetermined minimum thickness. Methods of joining the first and second portions, as well as various characteristics of such a valve body are described in the '339 and '477 patents.

The cylindrical web of such valve bodies is radially spaced apart from and symmetrically disposed about the common longitudinal axis. The valve body encloses a hollow that is substantially symmetrical about the common longitudinal axis and extends radially from the common longitudinal axis to the cylindrical web. The cylindrical web spaces apart and connects opposing walls of an integral seal retention groove in the valve body. Welding flash resulting from joining of the two portions may protrude from the cylindrical web into the integral seal retention groove, and the integral seal retention groove walls may comprise at least one serration for retaining an elastomeric seal.

The first portion of such a valve body may comprise a first guide stem extending away from the hollow along the first longitudinal axis, and the second portion of the valve body may comprise a second guide stem extending away from the hollow along the second longitudinal axis. These first and second guide stems may in turn comprise first and second longitudinal fluid passages respectively, the first and second longitudinal fluid passages each extending between the hollow and space outside the valve body. At least one of the first and second longitudinal fluid passages may comprise frangible pressure relief means, the frangible pressure relief means comprising, for example, at least one frangible disk transversely sealed across the fluid passage in a manner analogous to that described in the '421 patent.

A valve body as described above may be incorporated in a full-open-seat stem-guided valve, the valve comprising the above valve body, a corresponding full-open seat, and an elastomeric seal in the integral seal retention groove of the valve body. An embodiment of such a valve incorporated in a plunger pump fluid end, with a lower valve stem guide, a valve spring, and a combination top valve stem guide and spring retainer, is schematically illustrated in FIG. 9.

FIG. 9 schematically illustrates a cross-section of a fluid end sub-assembly 90. The subassembly includes a fluid end housing 50 in which oblong transition areas of the suction, discharge, plunger and access bores open on a barrel-profile central cavity. Fluid end housing 50, or portions thereof, may also be seen in FIGS. 18-23. These schematic illustrations may be compared with FIGS. 12-16 showing fluid end housing 50' in which circular transition areas of the suction, discharge, plunger and access bores open on a central cavity.

Detail drawing FIG. 17 shows an alternative embodiment of the partial cross-section shown in FIG. 16 wherein outside corners 188 and 188' are angular instead of being radiused as outside corners 88 and 88' are in FIG. 16. While the embodiment of FIG. 17 is somewhat less advantageous for stress redistribution than the embodiment of FIG. 16, manufacturing considerations (e.g., shorter setup time) or less stringent design criteria may make angular outside corners desirable in certain fluid end housing embodiments.

When any central cavity outside corners remain angular after machining of a barrel-profile, they may then be hand-ground to remove sharp edges. Depending on the skill of the operator, such hand-grinding may not be very consistent. But FEA suggests that hand-grinding or radiusing of outside corners typically has much less influence on local peak cyclic stress maxima in a fluid end housing than machining relatively large and consistent radii on inside corners. Thus, inconsistencies in hand-grinding of outside corners in barrel-profile central cavities will typically not substantially affect stress distribution in a fluid end housing.

Nevertheless, hand-grinding or related finishing operations are often specified during manufacturing of fluid end housings because these operations facilitate installation and/or maintenance of fluid end components. See, for example, FIG. 9 which shows suction valve 30, a combination suction valve spring retainer and top stem guide 32, and suction valve lower stem guide 34 for lower stem 23. Also included is discharge valve 40 with its top stem guide 42 and lower stem guide 44. Note the suction valve top stem guide and spring retainer 32 is secured in place spaced apart from the discharge valve lower stem guide 44 by side spacer 60 (see the '871 patent). Note also that suction valve 30 comprises frangible pressure relief means in the form of a frangible disk 31 transversely sealed in a longitudinal fluid passage within the top stem 33 in a manner analogous to that described in the '421 patent. See also FIGS. 27 and 28.

Discharge valve 40 is secured in discharge bore 45 by threaded retainer 43, which is shown above discharge valve top stem guide 42 in FIG. 9. Access bore plug 70 is secured in access bore 75 by threaded retainer 73. Plunger packing 82 is secured in plunger bore 85 by a threaded retainer in the form of gland nut 80, plunger packing 82 sealing plunger 81 during its reciprocating motion in plunger bore 85. Suction valve 30 is secured in suction bore 35 in part because suction valve seat 36 is fitted tightly into suction valve seat taper 37 and rests against ledge 38. Suction valve 30 is also secured in suction bore 35 in part by pressure exerted on suction valve body 25 by suction valve spring 39 which also acts against combination suction valve spring retainer and top stem guide 32.

FIG. 10 is seen to be similar in many respects to FIG. 9 except that suction valve 130 is seen to have only a top stem 33 and no bottom stem. FIGS. 9 and 10 show by example that different configurations of valves may be incorporated in fluid ends of the present invention. Note also that either suction valve 30 or suction valve 130 is installed in housing 50 by accessing suction bore 35 through access bore 75 and barrel-profile central cavity 99 (see FIGS. 18 and 19). The added clearance provided by the maximum diameter of barrel-profile central cavity 99 allows a combination suction valve spring retainer and top stem guide 32 to be secured in suction bore 35 substantially as shown, for example, in FIGS. 9 and 10.

Figure 1:
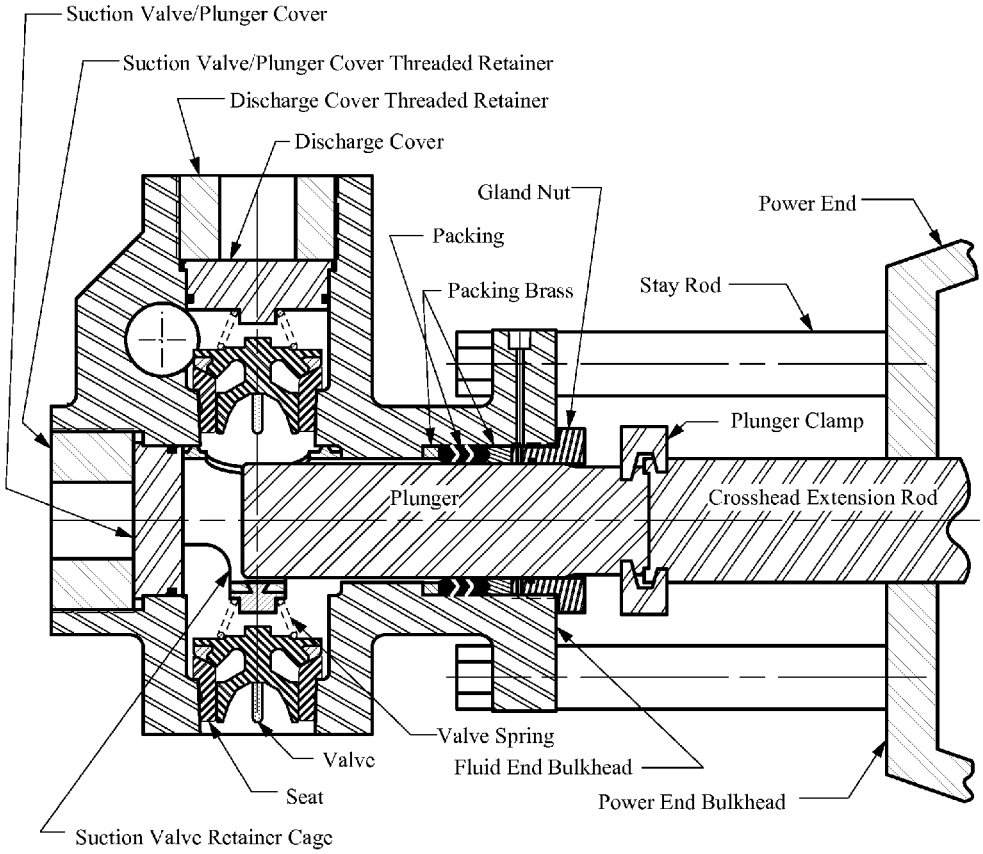
Prior Art Figure 1
FIG. 1 is a cross-sectional schematic view of a conventional plunger pump fluid end housing showing its connection to a power end by stay rods.
Figure 2:
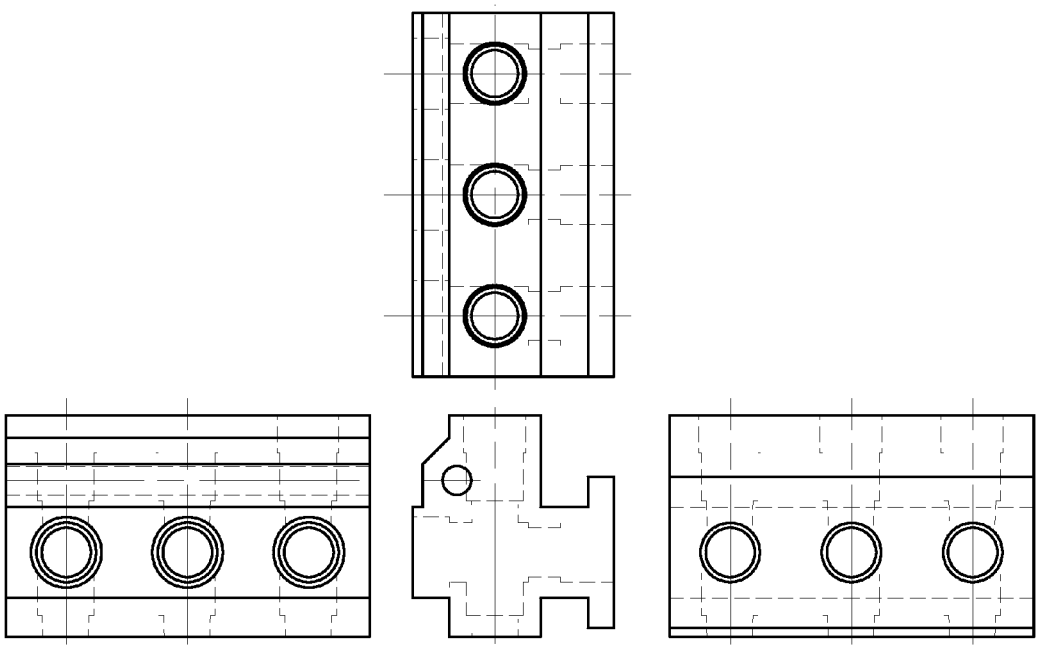
Prior Art Figure 2
FIG. 2 schematically illustrates a conventional Triplex plunger pump fluid end.
Figure 3:
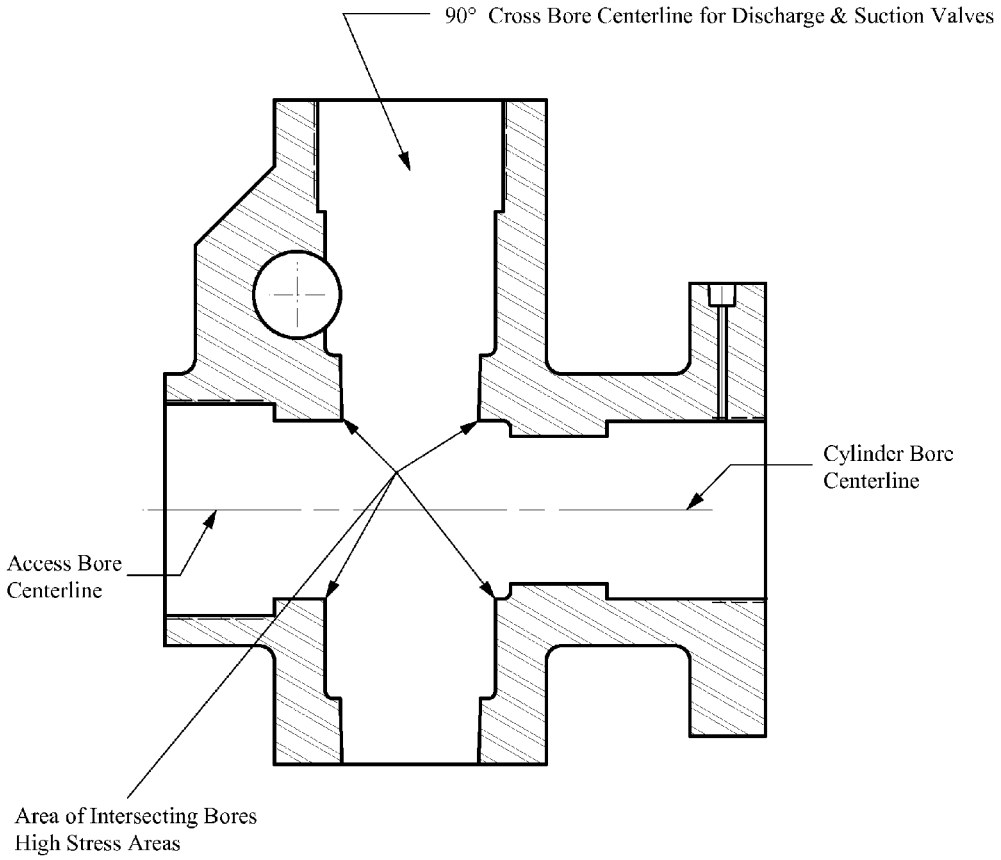
Prior Art Figure 3
FIG. 3 is a cross-sectional schematic view of suction, plunger, access and discharge bores of a conventional plunger pump housing intersecting a central cavity at right angles, with high stress indicated at bore intersections.
Figure 4:
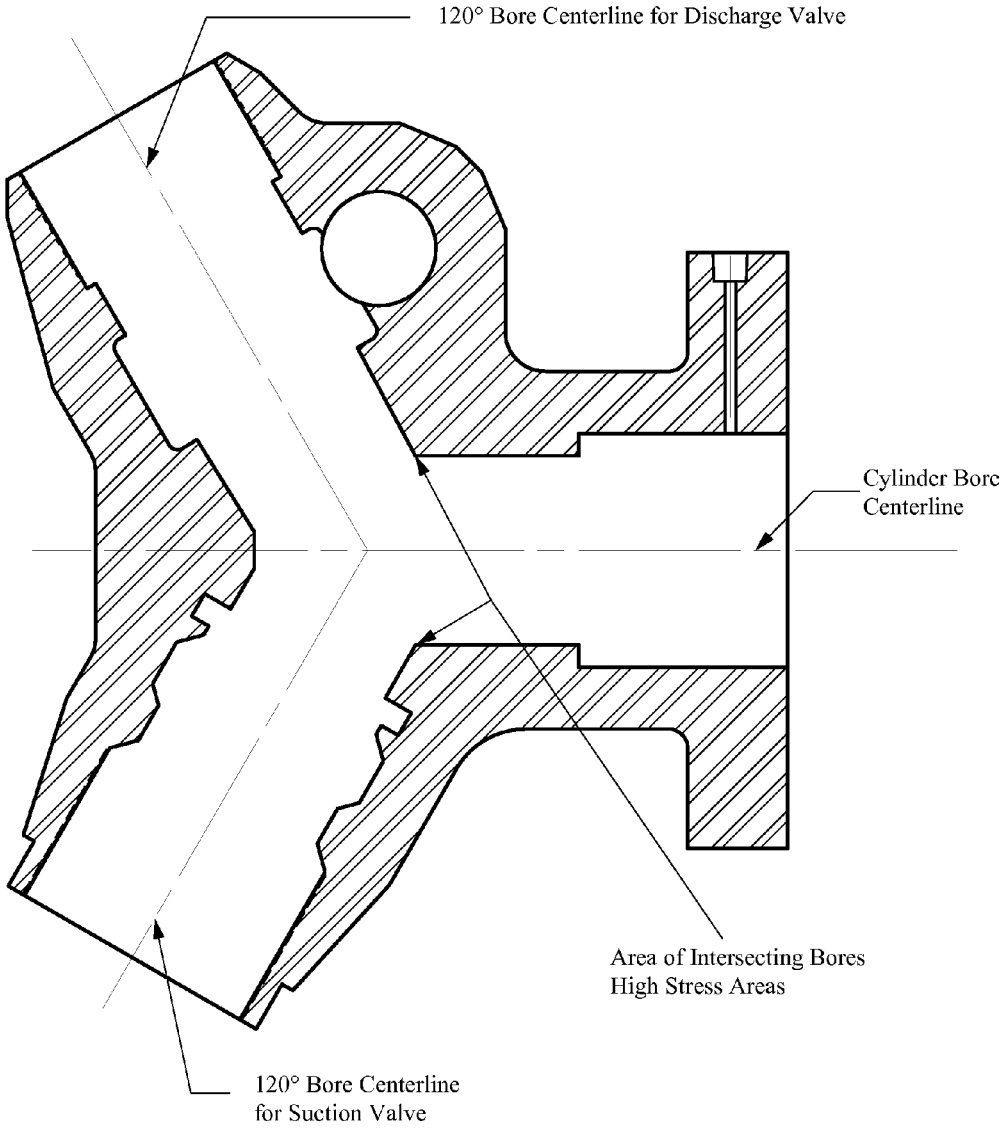
Prior Art Figure 4
FIG. 4 is a cross-sectional schematic view showing suction, plunger and discharge bores of a Y-block plunger pump housing intersecting at obtuse angles.
Figure 5:
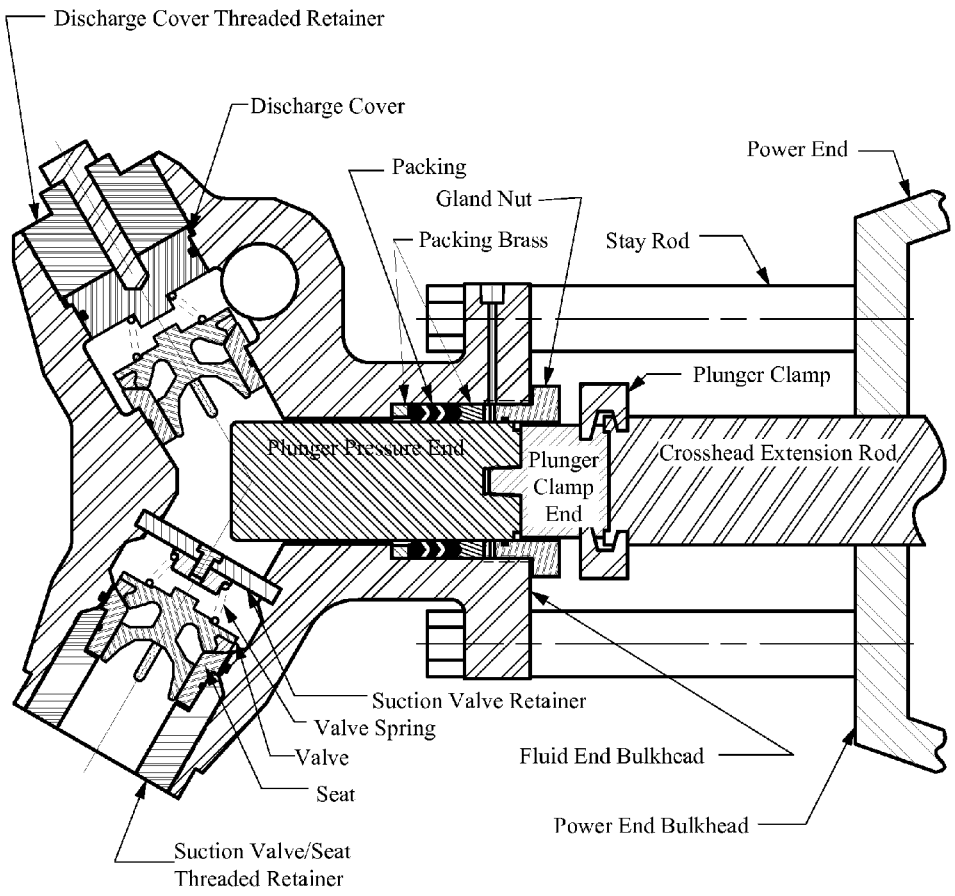
Prior Art Figure 5
FIG. 5 is a cross-sectional schematic view similar to that in FIG. 4, including internal plunger pump fluid end components.
Figure 6:
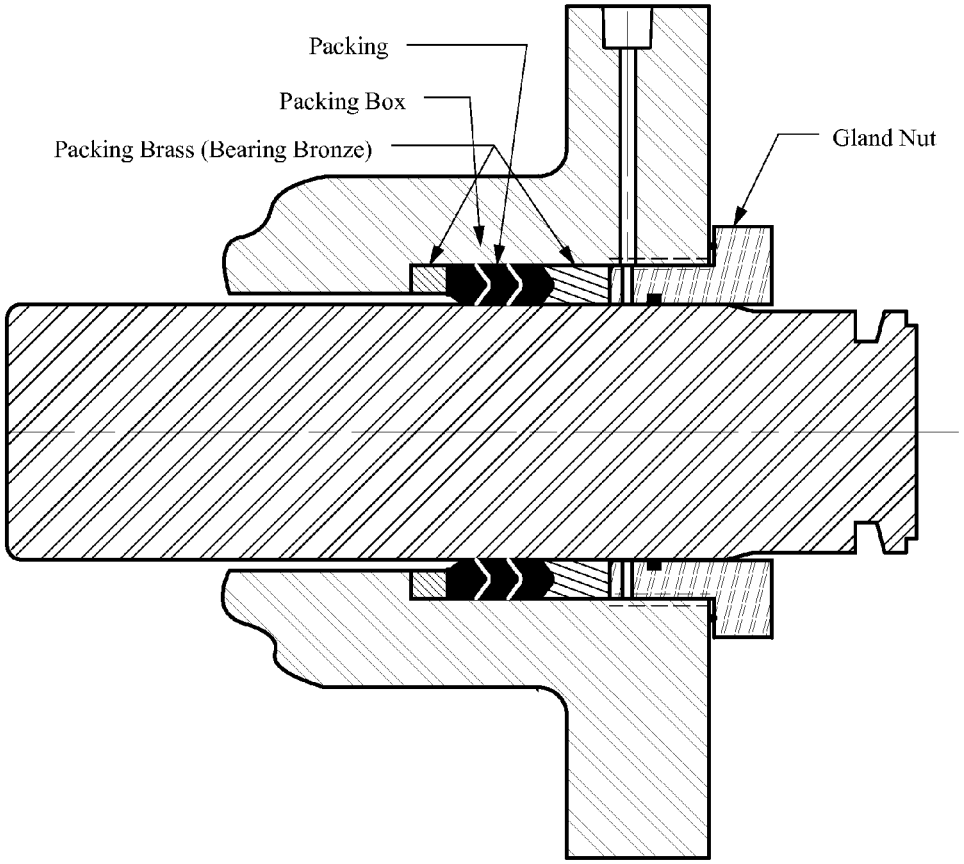
Prior Art Figure 6
FIG. 6 is a partial cross-sectional schematic view of conventional plunger packing and packing brass.
Figure 7:
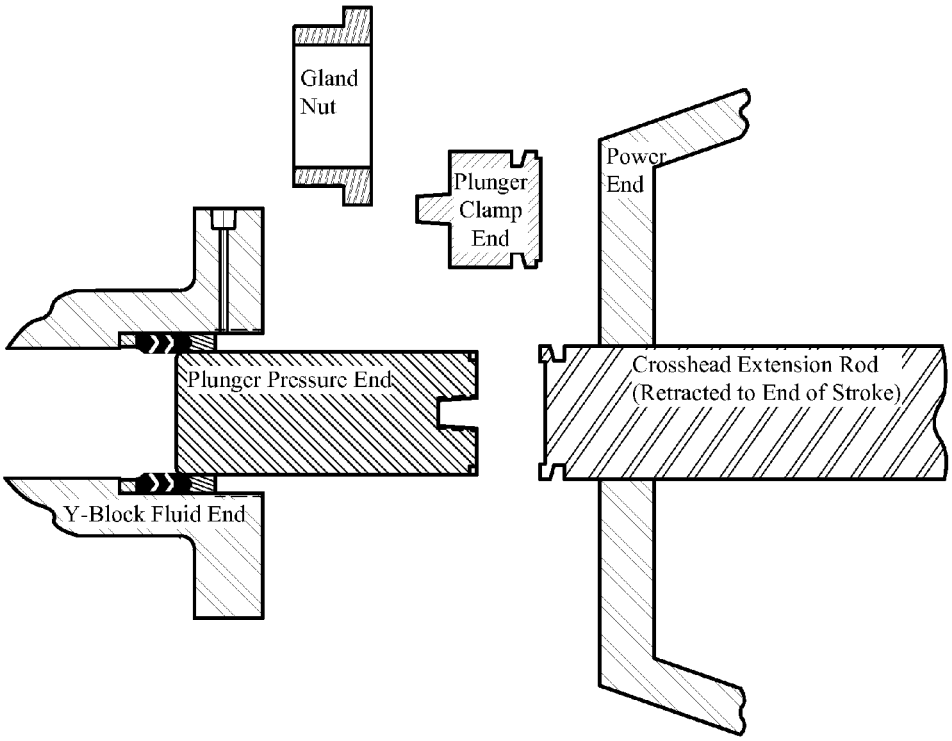
Prior Art Figure 7
FIG. 7 schematically illustrates portions of a Y-block plunger pump housing, together with a gland nut and plunger parts, with the plunger pressure end within the packing box.
Figure 8:
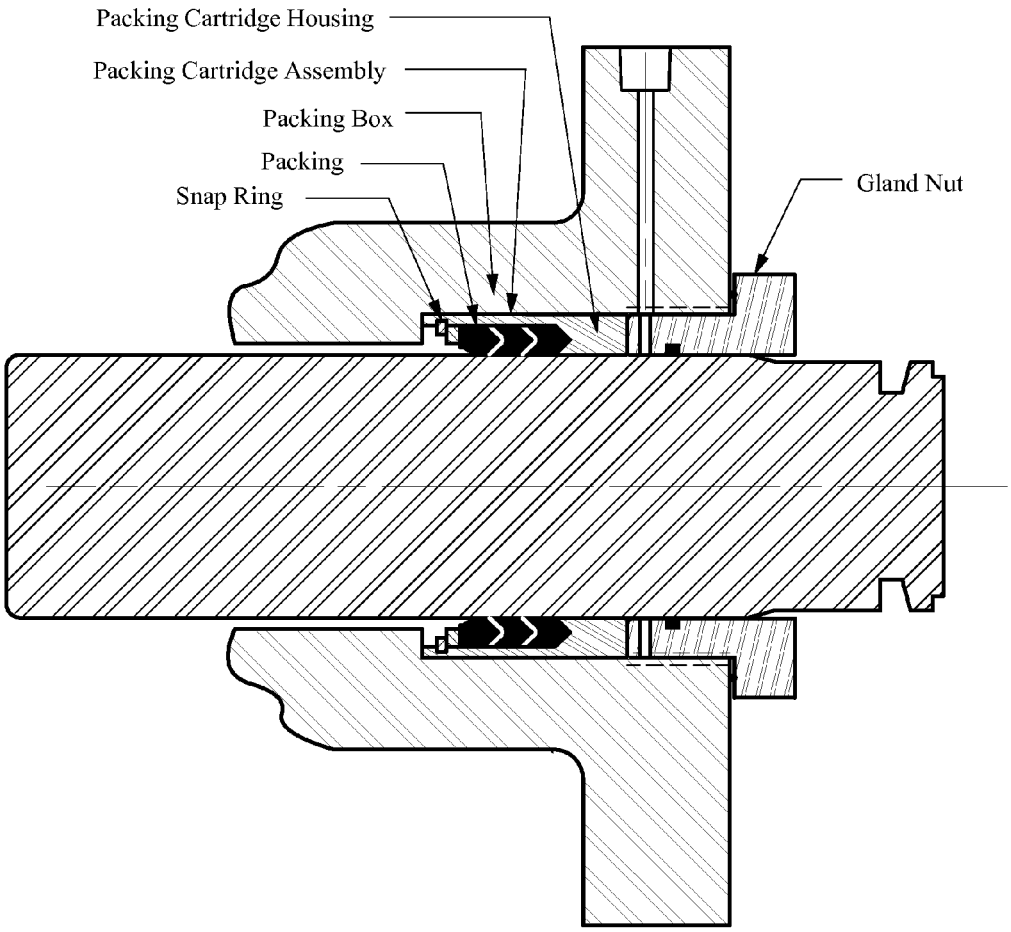
Prior Art Figure 8
FIG. 8 schematically illustrates a partial cross-sectional view of a plunger pump housing, together with a conventional packing cartridge and gland nut.
Figure 11:
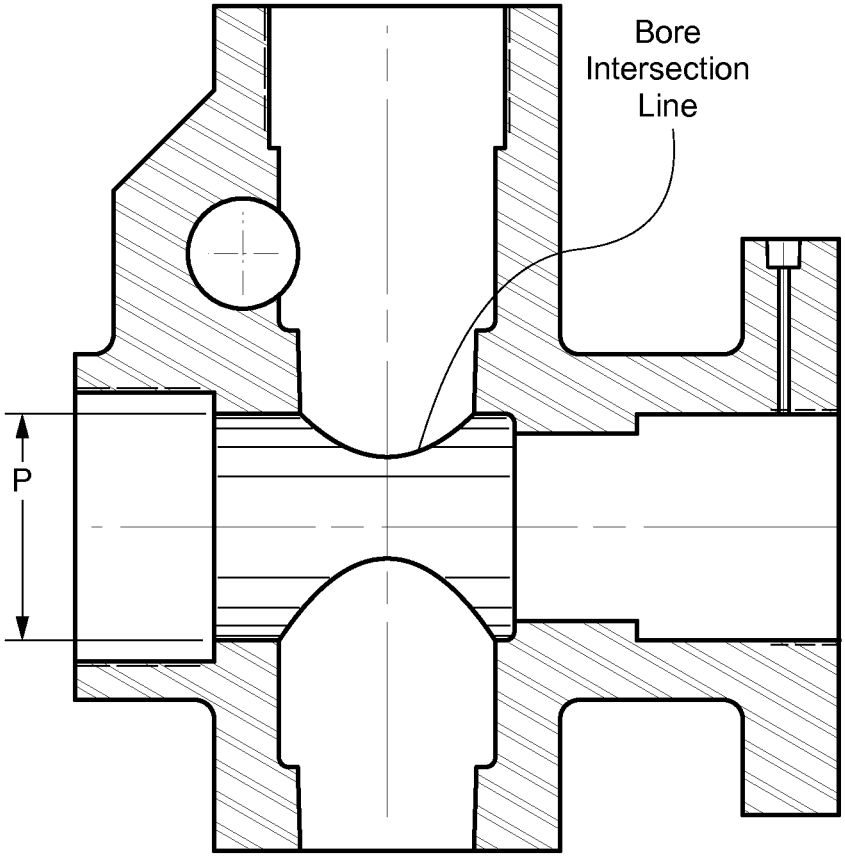
Prior Art Figure 11
FIG. 11 schematically illustrates a conventional fluid end housing with a horizontal cylindrical-profile central cavity (similar to those seen in FIGS. 1 and 3).
Figure 24:
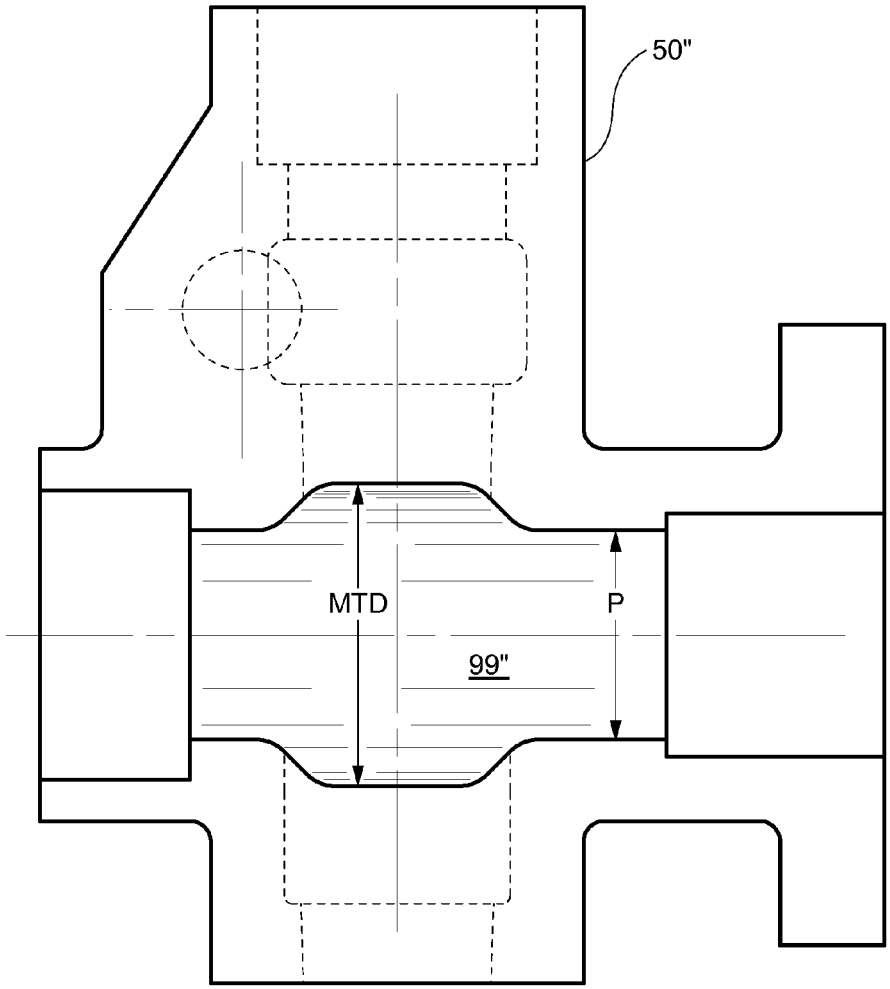
FIG. 24 schematically illustrates a cross-section of a fluid end housing with a barrel-profile central cavity machined about the collinear longitudinal axes of access and plunger bores.
Figure 25:
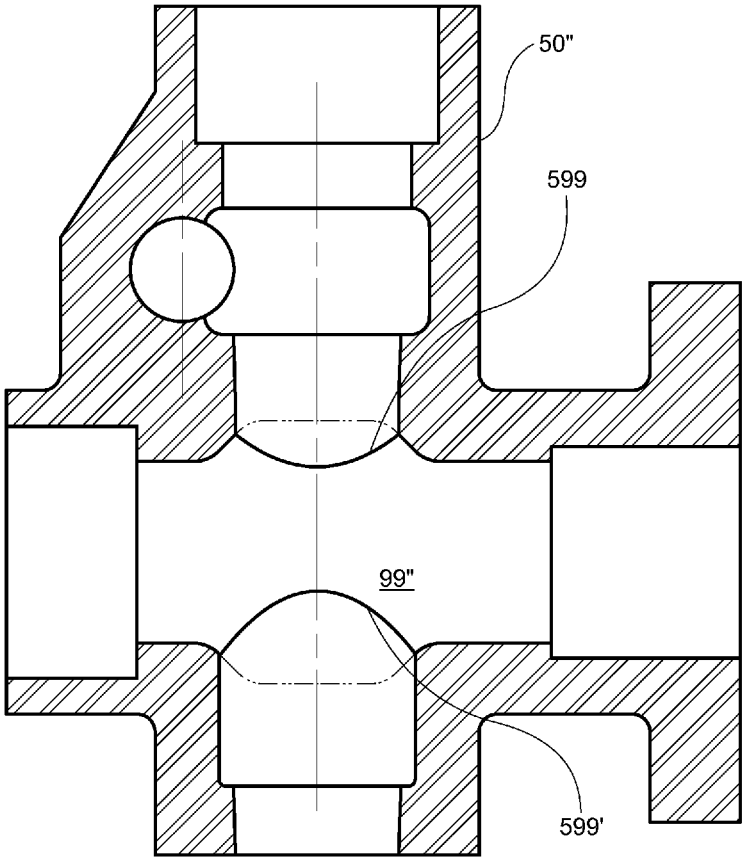
FIG. 25 is a cross-sectional view similar to that of FIG. 24 but schematically illustrating the bore intersection lines of circular transition areas of discharge and suction bores with the barrel-profile central cavity of FIG. 24.

FIG. 11 schematically illustrates differences between a conventional fluid end sub-assembly housing with a (horizontal) cylindrical-profile central cavity (similar to those seen in FIGS. 1 and 3) and the barrel-profile central cavity shown in FIGS. 24 and 25. Specifically, the cylindrical cavity diameter P relative to the overall housing dimensions as shown in FIG. 11 is substantially less than the barrel-profile maximum transverse diameter MTD shown in FIG. 24. Additionally, the relatively large and consistently formed chamfers seen in FIG. 24 are machined about a common axis comprising the collinear longitudinal axes of the plunger and access bores. Such machining is made possible by the relatively large clearance provided by the barrel-profile central cavity 99". Analogous chamfers, which themselves are effective in redistributing stress in housing 50", are not seen in the cylindrical central cavity of FIG. 11.

Figure 12:
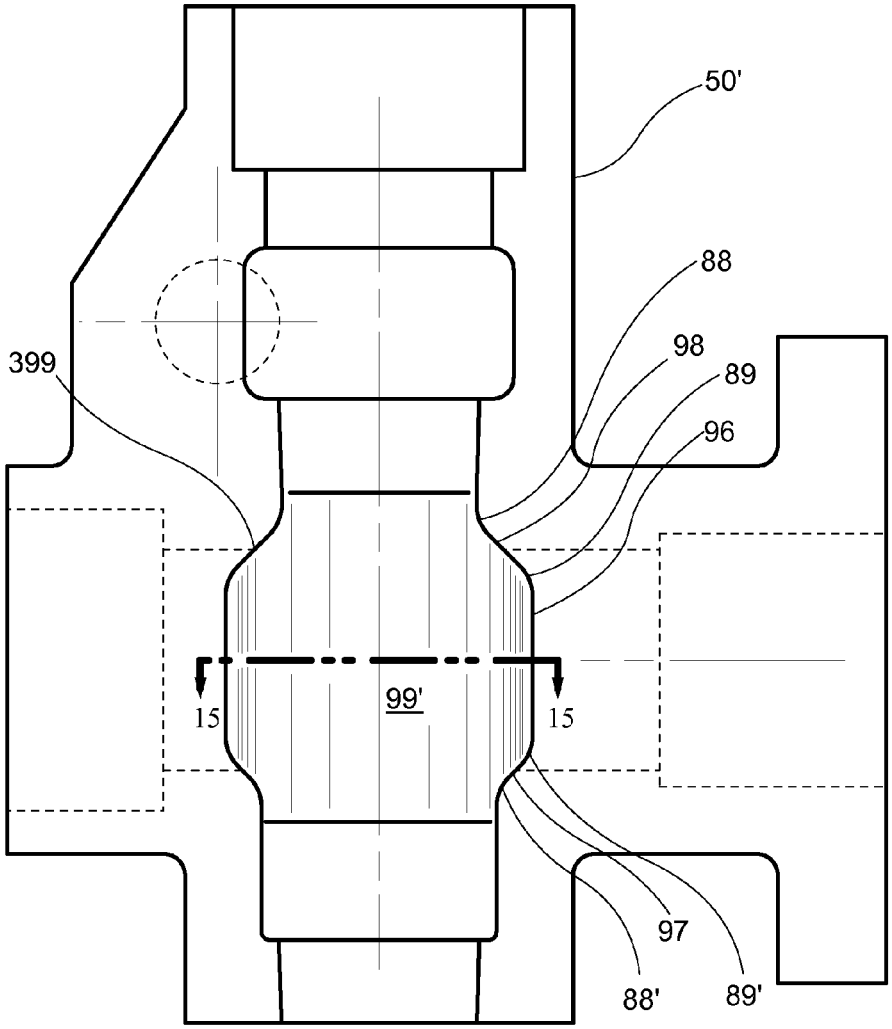
FIG. 12 schematically illustrates a cross-section of a fluid end housing with a barrel-profile central cavity machined about the collinear longitudinal axes of suction and discharge bores.
Figure 13:
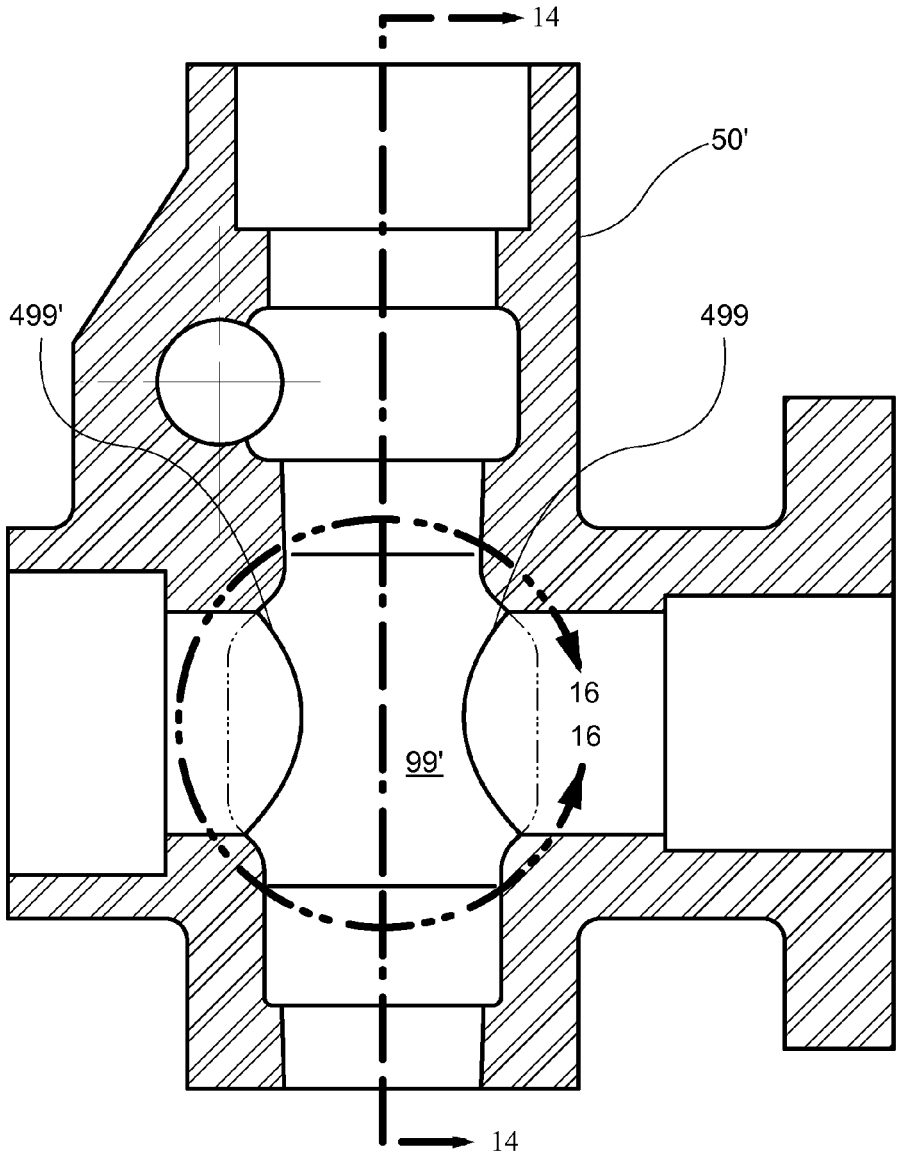
FIG. 13 is a cross-sectional view similar to that of FIG. 12 but schematically illustrating the bore intersection lines of circular transition areas of the suction, discharge, plunger and access bores with the barrel-profile central cavity of the fluid end housing of FIG. 12.

The (horizontal) barrel-profile central cavity of FIGS. 24 and 25 may be compared with the (vertical) barrel-profile central cavity shown in FIGS. 12 and 13. FIGS. 12 and 13 show circular transition areas of suction, discharge, plunger and access bores intersecting a barrel-profile central cavity having a central cavity wall 399. Bore intersection lines 499 and 499' in FIG. 13 schematically illustrate the intersections of circular plunger and access bores respectively with vertical barrel-profile central cavity 99'. Bore intersection lines 499 and 499' may be compared with bore intersection lines 599 and 599' in FIG. 25 schematically illustrating the intersections of circular discharge and suction bores respectively with horizontal barrel-profile central cavity 99".

Figure 14:
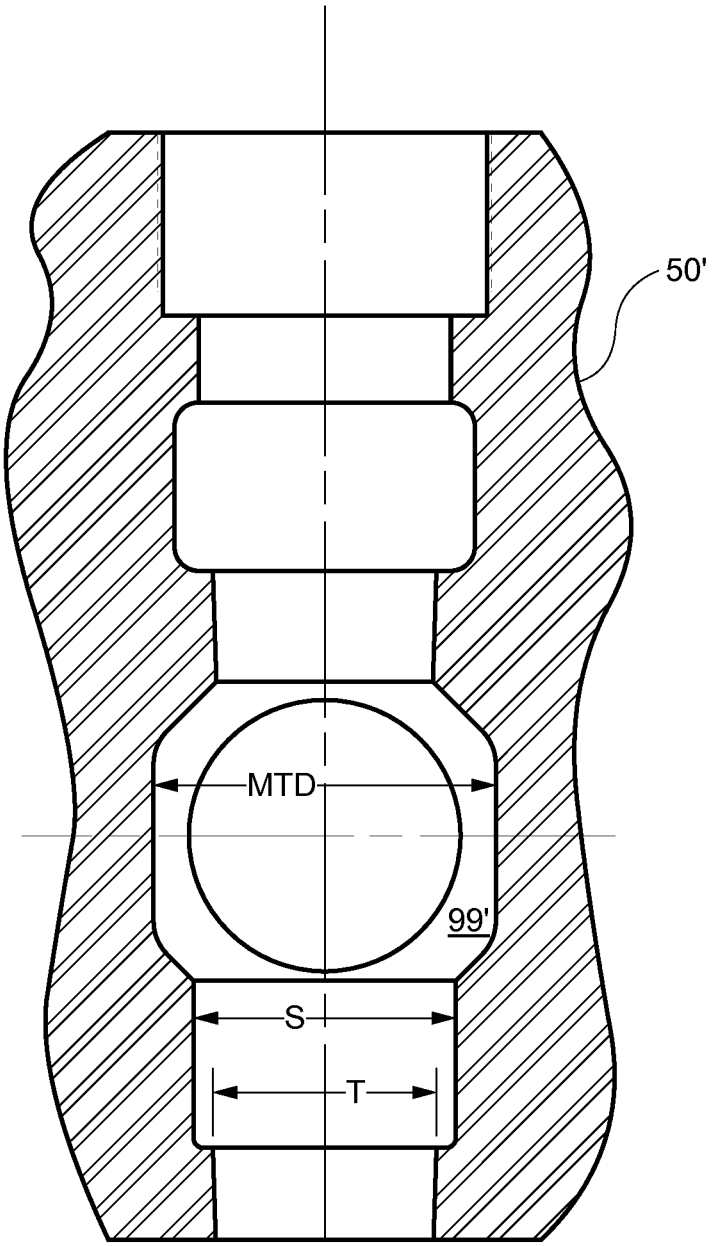
FIG. 14 schematically illustrates the cross-sectional view 14-14 which is indicated on FIG. 13 and which includes a circular plunger bore transition area.
Figure 15:
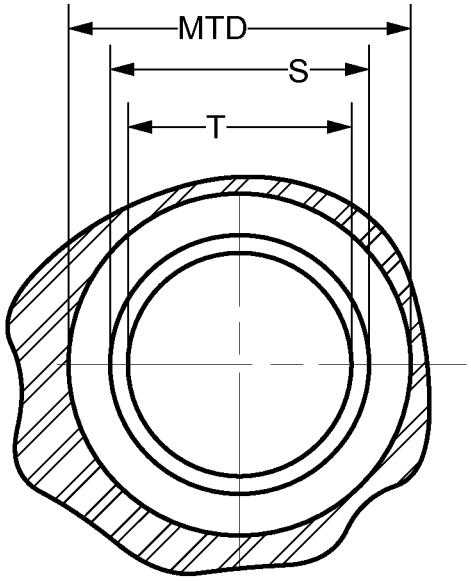
FIG. 15 schematically illustrates the partial cross-sectional view 15-15 which is indicated on FIG. 12 and which shows a circular suction bore transition area.

FIG. 14 schematically illustrates the cross-sectional view 14-14 which is indicated on FIG. 13 and which shows a (cylindrical) circular plunger bore transition area end-on, as well as suction bore maximum seat taper diameter T and suction bore valve body clearance diameter S. Diameter S is sufficiently larger than the maximum diameter of a suction valve body usable in fluid end housing 50' to allow relatively free flow of fluid between fluid end housing 50' and the suction valve body when the suction valve is open. Either diameter S or diameter T may guide dimensioning of barrel-profile cavity 99' as follows. The barrel-profile maximum transverse diameter MTD (see FIGS. 12, 14 and 15) may be dimensioned between approximately 110% and approximately 130% of diameter S. Alternatively, the MTD may be dimensioned between approximately 150% and approximately 175% of diameter T. In typical applications of these design criteria in fluid end housings wherein all bores have circular transition areas, local peak cyclic stress maxima associated with a vertical barrel-profile central cavity may be reduced approximately 25%, relative to local peak cyclic stress maxima in a fluid end housing with similar bore dimensions but with a central cavity that does not have a vertical barrel-profile. Further, analogous relative reductions in local peak cyclic stress maxima of approximately 50% are typically seen in fluid end housings wherein all bore transition areas opening on a vertical barrel-profile central cavity are oblong as described herein (see, e.g., FIGS. 18-23).

In contrast, the MTD of a horizontal barrel-profile central cavity (see FIGS. 24 and 25) as disclosed herein is dimensioned approximately 110% to approximately 120% of the circular piston bore transition area diameter P (see FIG. 24). In such an application, local peak cyclic stress maxima associated with a horizontal barrel-profile central cavity may be reduced approximately 18%, relative to local peak cyclic stress maxima in a fluid end housing with similar bore dimensions but with a central cavity that does not have a horizontal barrel-profile (see, generally, FIG. 11).

Thus, details of a plunger pump fluid end housing 50 as schematically illustrated herein are seen in FIGS. 18-23. The housing 50 comprises a suction bore 35 having a suction bore longitudinal axis and a suction bore transition area 335 (see FIG. 21), a plunger bore 85 having a plunger bore longitudinal axis and a plunger bore transition area 385 (see FIGS. 19 and 23), an access bore 75 having an access bore longitudinal axis and an access bore transition area 375 (see FIGS. 18 and 22), and a discharge bore 45 having a discharge bore longitudinal axis and a discharge bore transition area 345 (see FIG. 20). Because the transition areas of the suction, plunger and discharge bores are both oblong and outwardly flared near the bore intersections, they are easily seen in views like those of FIGS. 21, 23 and 20 respectively. On the other hand, the access bore transition area 375 is both oblong and substantially cylindrical to facilitate access to internal fluid end components. The oblong cylindrical transition area 375 is thus seen end-on in FIG. 22 and in longitudinal cross-section in FIG. 18.

In the embodiment of FIG. 18, the discharge bore longitudinal axis is substantially collinear with the suction bore longitudinal axis to form a common axis. A barrel-profile central cavity 99 connects the suction bore transition area 335 and the discharge bore transition area 345. The barrel-profile is symmetrical about the common axis, and the central cavity 99 is intersected by the plunger bore transition area 385 and the access bore transition area 375. All of the bore longitudinal axes lie substantially in a common plane As noted above, the barrel-profile of a central cavity can be machined during manufacture of a fluid end housing. For clarification, the profiles of two embodiments of this barrel-profile central cavity are shown in FIGS. 12 and 24 and described further below. Note that both of the two barrel-profile central cavities shown have transverse cross-sections that are circles or portions of circles. The transition areas of bores intersecting the central cavity may have oblong or circular transverse cross-sections. Note also that machining a barrel-profile about a common axis, as schematically illustrated in FIGS. 12 and 24, results in relatively large and consistent chamfers that together encompass all bore intersections and render all bore intersection angles obtuse.

FIGS. 16 and 17 schematically illustrate in detail that barrel-profile central cavity chamfers render bore intersection angles obtuse. Although FIGS. 16 and 17 show portions of the intersections of circular bore transition areas with a barrel-profile central cavity, analogous figures showing detail of oblong bore intersections with a barrel-profile central cavity such as those in FIG. 18 would similarly show that barrel-profile central cavity chamfers render those bore intersection angles obtuse. In the detail drawing FIG. 16, the outside corners 88 and 88' are shown radiused as they are in FIG. 12. Inside corners 89 and 89' are also radiused, but outside corners 87 and 87' are not radiused in this embodiment due to the relatively complex machining that would be needed. This is because outside corners 87 and 87' lie on the bore intersection line, which is a line in three-dimensional space (i.e., the bore intersection line does not lie in a plane). Fortunately, FEA shows that relatively large reductions in peak cyclic stress local maxima are obtained by radiusing inside corners (e.g., 89 and 89'), whereas relatively smaller benefits are obtained by radiusing outside corners such as 87 and 87'. Such angles may thus be angular in certain embodiments. Analogously, outside corners 188 and 188' are also not radiused in the embodiment shown in FIG. 17.

Figure 26:
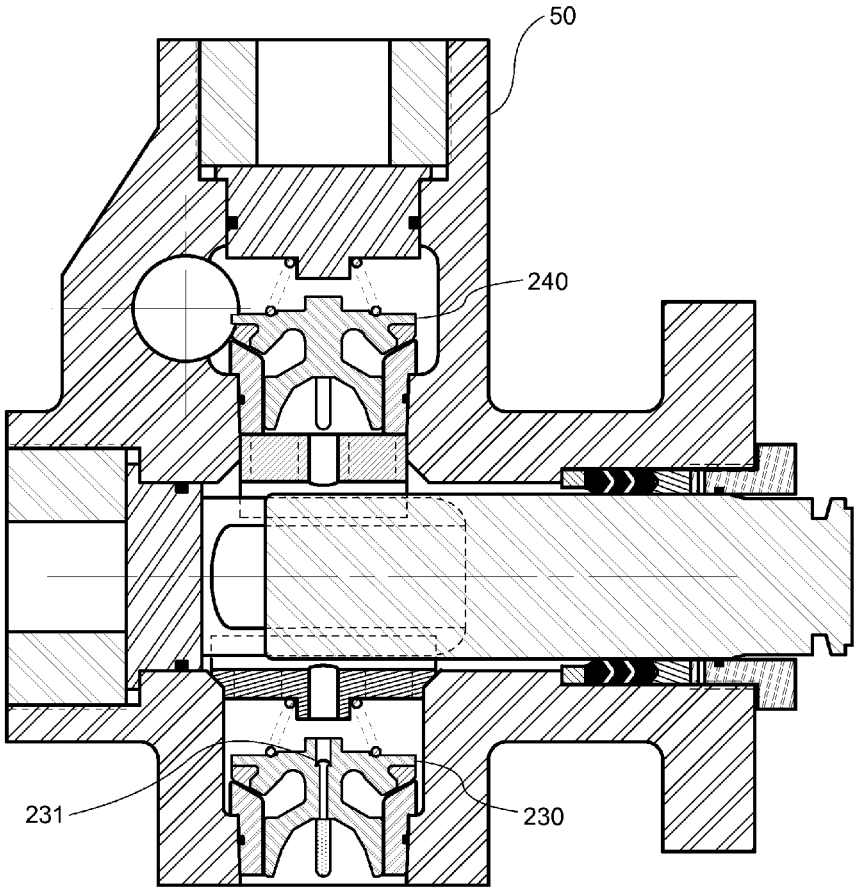
FIG. 26 schematically illustrates a cross-section of a fluid end sub-assembly analogous to that in FIGS. 9 and 10, including wing-guided suction and discharge valves with their respective valve spring retainers. The suction valve comprises frangible pressure relief means in the form of a frangible disk transversely sealed in a longitudinal fluid passage within the valve body.

An alternative embodiment of a fluid end is seen in FIG. 26, which schematically illustrates a cross-section of a fluid end sub-assembly analogous to that in FIGS. 9 and 10. Fluid end housing 50, is shown with wing-guided suction valve 230, wing-guided discharge valve 240, and their respective valve spring retainers. Note that the guides of valves 230 and 240 are also known as crow-foot guides, and they allow the use of full-open valve seats. Further, because there is no lower guide stem attached to the valve body, no lower stem guide is required. Guidance is provided instead by the interior walls of the corresponding valve seat. This design is analogous to illustrations in the '421 patent, which also show the frangible pressure relief means in the form of a frangible disk transversely sealed in a longitudinal fluid passage within the valve body. FIG. 26 schematically illustrates frangible disk 231 within a longitudinal fluid passage within the body of valve 230.

FIG. 27 schematically illustrates a cross-section of a valve body 103 for use in a full-open-seat stem-guided valve, valve body 103 enclosing a hollow 110, and frangible pressure relief means being present in the form of a frangible disk 131 transversely sealed in (first) longitudinal fluid passage 104 within top stem (or first guide stem) 106 which is part of first portion 210. Note that one or more frangible disks might additionally or alternatively transversely seal (second) longitudinal fluid passage 105 in lower stem (or second guide stem) 107 which is part of second portion 211. Note also that welding flash 108 may extend from cylindrical web 111 into integral seal retention groove 109. Integral seal retention groove 109 may additionally or alternatively comprise one or more serrations 114 for retaining a valve seal. FIG. 28 shows a cross-sectional view similar to that of FIG. 27 but with the addition of a cast-in-place elastomeric seal 115 enveloping welding flash 108 and interdigitating with serration(s) 114.

What is claimed is:

1. A method of manufacturing a plunger pump fluid end housing to redistribute stress, the method comprising: providing a plunger pump fluid end housing comprising a first bore having a first bore longitudinal axis and a first bore transition area, a second bore having a second bore longitudinal axis and a second bore transition area, a third bore having a third bore longitudinal axis and a third bore transition area, and a fourth bore having a fourth bore longitudinal axis and a fourth bore transition area, said first and second bore longitudinal axes being substantially collinear to form a common axis, and all bore longitudinal axes being coplanar; machining a barrel-profile central cavity into the housing in fluid communication with said first, second, third and fourth bores, said barrel-profile central cavity having a central cavity wall and connecting said first and second bore transition areas, said central cavity being formed substantially symmetrically about said common axis and having a maximum transverse diameter between relatively smaller transverse diameters of first and second end chamfers adjacent to said first and second bore transition areas respectively; said first end chamfer intersecting said first bore transition area, said third bore transition area, and said fourth bore transition area; and said second end chamfer intersecting said second bore transition area, said third bore transition area, and said fourth bore transition area; each said bore transition area having a plurality of bore intersection angles with said barrel-profile central cavity, and each said bore intersection angle being obtuse; estimating a first local maximum peak cyclic stress near a stress concentration in said central cavity wall and a second local maximum peak cyclic stress in said central cavity wall more distant from said stress concentration, said first local maximum peak cyclic stress being greater than said second local maximum peak cyclic stress; estimating a ratio of said first local maximum peak cyclic stress to said second local maximum peak cyclic stress; and adjusting said central cavity maximum transverse diameter in said machining step to alter said ratio by a predetermined amount to redistribute stress in said plunger pump fluid end housing.

2. The method of claim 1 wherein each said bore intersection angle is less than about 150 degrees.

3. The method of claim 2 wherein each said bore intersection angle is greater than about 120 degrees.

4. The method of claim 1 wherein at least one said bore intersection angle is about 135 degrees.

5. The method of claim 1 wherein at least one said bore has an oblong bore transition area.

6. The method of claim 1 wherein said central cavity comprises a plurality of inside corners, each said inside corner having a radius substantially equal to at least 10% of said maximum transverse diameter.

7. A plunger pump fluid end housing designed according to the method of claim 1.

* * * * *